US006666593B2

(12) United States Patent
Akaiwa

(10) Patent No.: US 6,666,593 B2
(45) Date of Patent: Dec. 23, 2003

(54) TAPE PRINTING APPARATUS AND IMAGE FORMING METHOD AND LABEL PRODUCING METHOD FOR THE TAPE PRINTING APPARATUS

(75) Inventor: Masao Akaiwa, Shiojiri (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 10/156,696

(22) Filed: May 28, 2002

(65) Prior Publication Data

US 2002/0197090 A1 Dec. 26, 2002

(30) Foreign Application Priority Data

Jun. 26, 2001 (JP) ..... 2001-192830
Jun. 26, 2001 (JP) ..... 2001-192834

(51) Int. Cl.[7] ..... B41J 5/30

(52) U.S. Cl. ..... 400/61; 400/611; 400/615.2; 400/708; 101/288

(58) Field of Search ..... 400/615.2, 613, 400/88, 61, 70, 76, 611, 208, 703, 708; 101/288

(56) References Cited

U.S. PATENT DOCUMENTS 4,321,670 A * 3/1982 Timmons ..... 400/63
RE35,562 E * 7/1997 Hirono et al. ..... 400/76
5,772,342 A * 6/1998 Yamamoto et al. ..... 400/615.2
6,092,946 A * 7/2000 Cockerill ..... 400/613
6,152,623 A * 11/2000 Palmer ..... 400/208
6,340,255 B1 * 1/2002 Konishi et al. ..... 400/615.2
6,491,461 B1 * 12/2002 Nakajima et al. ..... 400/693
6,550,994 B2 * 4/2003 Manduley ..... 400/611

* cited by examiner

*Primary Examiner*—Eugene H. Eickholt
(74) *Attorney, Agent, or Firm*—Hogan & Hartson, LLP

(57) ABSTRACT

There are provided a tape printing apparatus and an image forming method and a label producing method for the tape printing apparatus. A second print image area as an affixing area for having a second print image affixed thereto, is set in an area of the first print image, such that the second print image can be affixed to the affixing area, the second print image being printed on a second tape having a width equal to or smaller than that of the first tape. A first print image having the second print image area provided therein is formed.

39 Claims, 13 Drawing Sheets

TAPE PRINTING APPARATUS AND IMAGE FORMING METHOD AND LABEL PRODUCING METHOD FOR THE TAPE PRINTING APPARATUS

BACKGROUND OF THE INVENTION

1. Field of the Invention

This invention relates to a tape printing apparatus and an image forming method and a label producing method for the tape printing apparatus.

2. Prior Art

Recently, a wide variety of tapes different in width, background color, background pattern, material (texture), and the like are provided as tapes mountable within a tape printing apparatus. The user selects a desired type from the tapes, mounts the same in a tape printing apparatus, prints desired print images on it, and produces a label printed with the images.

However, in the conventional tape printing apparatus of the above-mentioned kind, it is not assumed that a plurality of types of tapes are overlaid and affixed to each other, and print images are edited and formed so as to be printed strictly on one type of a tape mounted therein. As a result, it has been impossible to produce a label by integrally using a plurality of types selected from a wide variety of types of tapes.

SUMMARY OF THE INVENTION

It is a first object of the invention to provide an image forming method and a label producing method for a tape printing apparatus, which makes it possible to integrally utilize a plurality of types of tapes different in width, background color, background pattern, material (texture), and the like, and thereby produce a diversified and attractive label.

It is a second object of the invention to provide a tape printing apparatus which is capable of integrally using a plurality of types of tapes different in width, background color, background pattern, material (texture), and the like, thereby forming and printing print images for use in producing diversified and attractive labels.

To attain the above first object, according to a first aspect of the invention, there is provided an image forming method for a tape printing apparatus that prints at least a first print image adapted to a first tape on at least the first tape.

The image forming method according to the first aspect of the invention is characterized by comprising the steps of:

setting a second print image area as an affixing area for having a second print image affixed thereto, in an area of the first print image, such that the second print image can be affixed to the affixing area, the second print image being printed on a second tape having a width equal to or smaller than that of the first tape; and forming a first print image having the second print image area provided therein.

According to this image forming method, in the tape printing apparatus for printing the first print image on the first tape in a manner adapted to a width of the first tape, the first print image is formed. Particularly, the second print image area, to which is affixed the second tape having a width equal to or smaller than that of the first tape, is set in the area of the first print image so as to form a first print image having the second print image area provided therein. Consequently, after the first print image is formed, if the image is printed on the first tape, it is possible to make the first label from a portion of the first tape printed with the image, and affix the second label formed by another tape (second tape) printed with the second print image, onto (the second print image area of the first print image of) the first label, thereby producing a new label (composite label) (as a result of synthesis by affixation). In this case, as the second tape, a tape different in type from the first tape can be selected from various types of tapes, so that it is possible to edit and produce the first print image by making use of the difference between the tapes. This makes it possible to integrally make use of a plurality of types of tapes which are different in width, background color, background pattern, texture, and so forth, thereby producing a diversified and attractive composite label.

Preferably, the first print image includes a plurality of paragraphs, and the step of setting the second print image area includes assigning at least one of the plurality of paragraphs to the second print image area.

According to this preferred embodiment, the first print image includes a plurality of paragraphs, and at least one of the plurality of paragraphs is set to be assigned to the second print image area when the second print image is affixed. Hence, if the first print image is printed on the first tape, and the second print image is printed on the second tape different from the first tape in width, background color, background pattern, texture, and the like, to properly affix the same onto the second print image area (synthesize the second print image with the first print image), it is possible to assign at least one paragraph to the second print image. This makes it possible to produce (a first print image for) a composite label appearing to be provided with an attractive paragraph-enclosing box.

Preferably, the first print image includes a plurality of lines, and the step of setting the second print image area includes assigning at least one of the plurality of paragraphs to the second print image area.

According to this preferred embodiment, the first print image includes a plurality of lines, and at least one of the plurality of paragraphs is assigned to the second print image area when the second print image is affixed. Hence, if the first print image is printed on the first tape, and the second print image is printed on the second tape different from the first tape in width, background color, background pattern, texture, and the like, to affix (synthesize) the same on the second print image area, it is possible to assign at least one line to the second print image. This makes it possible to produce (a first print image for) a composite label appearing to be provided with an attractive line-enclosing box.

Preferably, the first print image has a literal string formed of a plurality of characters, and the step of setting the second print image area includes assigning at least part of the literal string to the second print image area.

According to this preferred embodiment, the first print image has a literal string including a plurality of characters, and at least part of the literal string is assigned to the second print image area when the second print image is affixed. Hence, if the first print image is printed on the first tape, and the second print image is printed on the second tape different from the first tape in width, background color, background pattern, texture, and the like, to affix (synthesize) the same on the second print image area, it is possible to assign at least part of the literal string to the second print image. This makes it possible to produce (a first print image for) a composite label appearing to be provided with an attractive literal string-enclosing box (character-enclosing box).

Preferably, the first print image includes a plurality of characters, and the step of setting the second print image area includes assigning at least one of the plurality of characters to the second print image area.

According to this preferred embodiment, the first print image includes a plurality of characters, and at least one of the plurality of characters is assigned to the second print image area when the second print image is affixed. Hence, if the first print image is printed on the first tape, and the second print image is printed on the second tape different from the first tape in width, background color, background pattern, texture, and the like, to affix (synthesize) the same on the second print image area, it is possible to assign at least one character to the second print image. This makes it possible to produce (a first print image for) a composite label appearing to be provided with an attractive character-enclosing box.

Preferably, the step of setting the second print image area includes setting the second print image area such that the second print image area is contained in the area of the first print image in a manner enclosed by a double enclosing box.

According to this preferred embodiment, the second print image area is set such that it is contained in the area of the first print image in a manner enclosed by a double enclosing box. More specifically, the second print image is printed on the second tape different from the first tape in width, background color, background pattern, texture, and the like, to affix (synthesize) the same on the second print image area, whereby it is possible to cause an contour (outline of the second print image: contour of the second label to be affixed to the second print image area, when a non-transparent tape is employed) to appear as the enclosing box of the second print image. This makes it possible to produce (a first print image for) a (composite) label appearing to be provided with an attractive enclosing box.

Preferably, the step of forming the first print image includes forming the first print image such that the first print image includes a mark image for specifically indicating the second print image area.

According to this preferred embodiment, the first print image is formed such that it includes a mark image for specifically indicating the second print image area. Therefore, the (second label printed with the) second print image can be affixed with ease, that is, a composite label formed by synthesizing the second print image with the first print image can be produced with ease.

Preferably, the second print image area is set as a polygonal area, and the step of forming the first print image includes forming the first print image such that the first print image includes corner marks as the mark image, the corner marks indicating respective positions of corners of the polygonal area.

According to this preferred embodiment, the second print image area is set as a polygonal area, and the first print image includes corner marks indicative of respective positions of the corners of the polygonal area, thereby making it possible to specifically indicate the second print image area.

Preferably, the step of forming the first print image includes forming the first print image such that the first print image includes a contour image as the mark image, the contour image indicating an outline of the second print image area by a dotted line or a solid line.

According to this preferred embodiment, the first print image includes a contour image for indicating an outline of the second print image area by a dotted line or a solid line, whereby it is possible to specifically indicate the second print image area.

Preferably, the mark image is arranged such that the mark image is hidden under the second print image when the second print image is affixed.

According to this preferred embodiment, the mark image is hidden under the second print image when the second print image is affixed, so that the second print image area can be specifically indicated by the mark image. Further, the mark image is hidden under the second print image by affixing the (second label printed with the) second print image to the second print image. This contributes to enhancement of appearance of the label. In this case, if a mark image, such as a corner mark or an outline, is arranged slightly inward of the actual corner or outline of the second print image (or the non-transparent tape material of a second label), the affixing area can be indicated specific enough, whereas when the second print image is affixed, the mark image is hidden under the second print image.

Preferably, the step of forming the first print image includes forming the first print image such that a color different from colors in other areas of the first print image is arranged in either a whole area of the second print image or an area narrower than the whole area of the second print image by a predetermined extent, and the second print image area is specifically shown by a boundary line of arrangement of the different colors.

According to this preferred embodiment, a color different from colors arranged in other areas of the first print image is arranged either in a whole or part of the second print image area, the part being smaller in size than the whole area of the second print image by a predetermined extent, whereby it is possible to exploit the difference between colors to specifically indicate a boundary dividing the areas. Now, also when a color is arranged in the part of the second print image area, smaller than the whole second print image area by the predetermined extent, similarly to the case of the whole second print image area being colored, it is possible to specifically indicate the second print image area since the part is smaller in size by a (predetermined) extent determined in advance. This makes it possible to hide the colored portion under the (second label printed with the) second print image, similarly to the case of using corner marks and using the outline of the second print image area.

Preferably, the image forming method further includes the step of forming the second print image before the first print image is printed.

According to this preferred embodiment, the second print image can be formed before the first print image is printed, and hence the second print image can be formed immediately after forming the first print image, which makes it easy to form the second print image.

Preferably, the image forming method further includes the step of displaying a synthetic image which is formed by synthesizing the second print image with the first print image in a manner superposed on the second print image area.

According to this preferred embodiment, the synthetic image formed by synthesizing the second print image with the first print image in a manner superposed thereon in the second print image area can be displayed, so that it is possible to view or check on the whole image (synthetic image) by displaying it on the display screen, without actually producing the above labels (first label, second label, synthetic label). As a result, the check (display) can be performed before producing the first label and the second label. This makes it possible to reduce the waste of producing a label (tape) having an undesired synthetic image printed thereon and produce a label after re-editing and checking on the same again.

Preferably, the first tape and the second tape are different in kind from each other.

According to this preferred embodiment, the first label and the second label are different in type of tape from each other. This makes it possible to integrally utilize a plurality of types of tapes which are different in width, background color, background pattern, texture, and so forth, thereby producing a diversified and attractive composite label.

Preferably, the second tape is a transparent tape.

According to this preferred embodiment, when a composite label is produced by affixing the second tape (second label) printed with the second print image onto the first print image printed on the first tape, if the second tape is transparent, the second print image printed on the second tape appears to be formed directly on (the area of) the first print image, and even if the outer periphery of the second tape (portion of the tape material of the second tape: transparent portion) overlaps the first print image, the first print image under the second tape can be seen through. In the image forming method, since the second tape has a transparent background, the second print image area set in the first print image area can be set to the area of the non-transparent portion of the second print image. Thus, it is possible to produce a label effectively making use of the area within the first print image based on the properties of transparency of the second tape.

To attain the above first object, according to a second aspect of the invention, there is provided a label producing method comprising the steps of:

setting a second print image area as an affixing area for having a second print image affixed thereto, in an area of the first print image, such that the second print image can be affixed to the affixing area, the second print image being printed on a second tape having a width equal to or smaller than that of the first tape;

forming a first print image having the second print image area provided therein;

printing the first print image on the first tape to produce a first label having the first print image printed thereon;

mounting the second tape in a tape printing apparatus;

printing the second print image on the second tape; and producing a second label having the second print image printed thereon.

According to this label producing method, the first print image, which has the second print image area to which the second print image is to be affixed, provided therein, is printed on the first tape to produce the first label, and the second print image is printed on the second tape to produce the second label. After that, the second print image of the second label is affixed to the second print image area of the first print image printed on the first label, whereby it is possible to produce a composite label easily. In this case, it is possible to select different types of tapes as the first tape and the second tape from a wide variety of types of tapes as well as to edit and produce the first print image and the second print image by making use of the difference between the tapes in use. This makes it possible to integrally utilize a plurality of types of tapes which are different in width, background color, background pattern, texture, and so forth, thereby producing a diversified and attractive composite label.

To attain the above second object, according to a third aspect of the invention, there is provided a tape printing apparatus comprising:

first tape-mounting means for mounting a first tape having a first tape width as a print medium on which a first print image is to be printed;

second print image area-setting means for setting a second print image area for having a second print image affixed thereto, in an area of the first print image, the second print image being printed on a second tape having a second tape width equal to or smaller than that of the first tape;

first print image-forming means for forming the first print image having the second print image area provided therein; and first tape-printing means for printing the first print image on the first tape.

According to this tape printing apparatus, the first tape having the first tape width is mounted in the apparatus, and an area for having the second print image of the second tape affixed thereto is set in the area of the first print image to be printed on the first tape. Now, the second tape has a second tape width equal to or smaller than that of the first tape. Then, the first print image having the second print image area provided therein is formed for being printed on the first tape. Consequently, it is possible to make a label (first label) from the portion of the first print image and affix a label (second label) formed by another tape (second tape) printed with the second print image, to the second print image area provided in the first print image, thereby producing a new label (composite label). In forming the composite label, a tape different in type from the first tape can be selected from various types of tapes as the second tape. More specifically, when the first print image to be printed on the first tape is edited and formed, the image edit and forming operation can be carried out in view of the area of the second print image (second label) provided by another tape. This makes it possible to integrally make use of a plurality of types of tapes which are different in width, background color, background pattern, texture, and so forth, thereby producing a diversified and attractive composite label. Further, if the second print image to be printed on the second tape is formed and printed similarly to the first print image printed on the first tape, it is also possible to synthesize (affix) a third print image (third label) printed on still another tape (third tape), on the second print image on the second tape.

Preferably, the first print image-forming means includes first print image edit means for editing the first print image, the second print image area-setting means including tape shift-instructing means for issuing a tape shift instruction to hierarchically shift a tape edit mode from a first tape edit mode for carrying out an edit operation for the first tape to a second tape edit mode for carrying out an edit operation for the second tape, and the second print image area-setting means is enabled to set the second print image area when the tape shift instruction is issued.

According to this preferred embodiment, it is possible to edit the first print image, and issue the tape shift instruction to hierarchically shift the apparatus from the first tape edit mode for carrying out an edit operation for the first tape to the second tape edit mode for carrying out an edit operation for the second tape. When the tape shift instruction is issued, the second print image area can be set. Therefore, by using the tape shift instruction in view of the edited state of the first print image, it is possible to hierarchically switch the tape edit mode to the second tape edit mode and set various second print image areas.

Preferably, the first print image edit means includes paragraph break insertion-instructing means for issuing a paragraph break insertion instruction for providing a new paragraph in the first print image, and the second print image area-setting means includes tape shift/paragraph break insertion-setting means for setting the new paragraph as the second print image area when the paragraph break insertion instruction and the tape shift instruction are issued simultaneously or in a predetermined sequence.

According to this preferred embodiment, a paragraph break insertion instruction for arranging a new paragraph in the first print image can be issued. When the paragraph break insertion instruction and the tape shift instruction are issued simultaneously or in a predetermined sequence, a new paragraph is set as the second print image area. Therefore, through the key operations, it is possible to shift the apparatus to the second tape edit mode, and set the second print image area (new paragraph). This makes it possible to produce (a first print image for) a (composite) label appearing to be provided with an attractive paragraph-enclosing box.

Preferably, the first print image edit means includes new line start-instructing means for issuing a new line start instruction for starting a new line in the first print image, and the second print image area-setting means includes tape shift/new line start-setting means for setting the new line as the second print image area when the new line start instruction and the tape shift instruction are issued simultaneously or in a predetermined sequence.

According to this preferred embodiment, a new line start instruction for starting a new line in the first print image can be issued. When the new line start instruction and the tape shift instruction are issued simultaneously or in a predetermined sequence, a new line is set as the second print image area. Therefore, through these operations, it is possible to shift the apparatus to the second tape edit mode, and set the second print image area (new line). This makes it possible to produce (a first print image for) a (composite) label appearing to be provided with an attractive line-enclosing box.

Preferably, the first print image edit means includes literal string range-designating means for carrying out literal string range designation for designating a range of part of a literal string in the first print image, and the second print image area-setting means further includes tape shift/literal string range-setting means for setting the range of the part of the literal string designated by the literal string range-designating means as the second print image area when the literal string range designation and the tape shift instruction are issued simultaneously or in a predetermined sequence.

According to this preferred embodiment, it is possible to effect literal string range designation for designating the range of part of a literal string in the first print image. When the literal string range designation and the tape shift instruction are issued simultaneously or in a predetermined sequence, the designated range of the literal string is set as the second print image area. Therefore, through these operations, it is possible to shift the apparatus to the second tape edit mode, and set the second print image area (the area of a literal string in the designated range). This makes it possible to produce (a first print image for) a (composite) label appearing to be provided with an attractive literal string-enclosing box (character-enclosing box). It should be noted that the literal string range-designating means includes a so-called cursor which is capable of designating the range of a literal string by specifying a start point (first character) and an end point (last character) of the literal string.

Preferably, the first print image edit means includes character-designating means for carrying out character designation for designating at least one character in the first print image, and the second print image area-setting means further includes tape shift/character-setting means for setting a range of the at least one character designated by the character-designating means as the second print image area when the character designation and the tape shift instruction are issued simultaneously or in a predetermined sequence.

According to this preferred embodiment, it is possible to effect character designation for designating at least one character in the first print image. When the character designation and the tape shift instruction are issued simultaneously or in a predetermined sequence, the range of the at least one character designated is set as the second print image area. Therefore, through these operations, it is possible to shift the apparatus to the second tape edit mode, and set the second print image area (the area of characters in the designated range). This makes it possible to produce a first print image for a (composite) label appearing to be provided with an attractive character-enclosing box. It should be noted that the character-designating means includes the so-called cursor.

Preferably, the tape printing apparatus further includes second tape print character size-determining means for determining a size of characters in the second print image in the second tape edit mode, and the first print image edit means includes character size-adjusting means for adjusting a size of characters in the first print image based on the determined size of characters in the second print image.

According to this preferred embodiment, the size of characters in the second print image is determined in the second tape edit mode, and the size of characters in the first print image is adjusted based on the determined size of characters in the second print image. Therefore, when the (second label printed with the) second print image is affixed, the size of characters in the second print image and the size of characters in the first print image can be well-balanced, thereby making it possible to produce an attractive (composite) label by affixation of the second label.

Preferably, the first print image edit means includes enclosing box-instructing means for issuing an enclosing box instruction for causing the first print image to be formed as an image with an enclosing box, and the second print image area-setting means further includes second tape box-setting means for setting an internal area of the first print image, obtained by excluding, from an area of the first print image, a portion having a predetermined width and extending along a periphery of the area as the second print image area when the enclosing box instruction and the tape shift instruction are issued simultaneously or in a predetermined sequence.

According to this preferred embodiment, it is possible to issue an enclosing box instruction for instructing that the first print image is formed as an image with an enclosing box. When the enclosing box instruction and the tape shift instruction are issued simultaneously or in a predetermined sequence, a portion having a predetermined width and extending along a periphery of the area is set as the second print image area. More specifically, the second print image area in this case is formed by an area narrower (smaller in size) than the area of the first print image by a predetermined width, and hence when the (second label printed with) the second print image is affixed to this area, the contour thereof (the outline of the second print image: the contour of the second label to be affixed, when a non-transparent tape is employed) appears as the enclosing box of the second print image. Thus, it is possible to shift the apparatus to the second tape edit mode, and set the second print image area (the area of characters in the designated range) as well as to produce (a first print image for) a (composite) label appearing to be provided with an attractive enclosing box.

Preferably, the second print image area-setting means further includes tape shift cancellation-instructing means for issuing a tape shift cancellation instruction for restoring the apparatus from the second tape edit mode to the first tape edit mode after setting the second print image area.

According to this preferred embodiment, it is possible to issue a tape shift cancellation instruction for restoring the apparatus from the second tape edit mode to the first tape edit mode, after setting the second print image area. Therefore, if the second print image area has been set, it is possible to cancel the second tape edit mode (tape shift cancellation) to restore the apparatus to the first tape edit mode at a desired time point. In addition, if the second print image area has been set, the apparatus can be configured to perform automatic cancellation (automatic tape shift cancellation). Further, the apparatus may be configured such that the user can select one of the tape shift cancellation and the automatic tape shift cancellation as he desires, or either of them can be automatically selected depending on the edited state the first print image before the tape shift is effected.

Preferably, the tape shift cancellation instruction is issued through the same operation as carried out for issuing the tape shift instruction.

According to this preferred embodiment, the tape shift cancellation instruction is issued through the same operation as carried out for issuing the tape shift instruction, and hence the apparatus can be shifted between the first tape edit mode and the second tape edit mode if only the same operation is carried out.

Preferably, the first tape-mounting means is configured such that the second tape can be mounted therein, and includes second tape-mounting detection means for detecting that the first tape has been replaced by the second tape.

According to this preferred embodiment, it is possible to mount the first tape and the second tape in the same tape-mounting means. Further, since it is detected that the first tape has been replaced by the second tape, it is possible to confirm that the first tape has been replaced to print the second print image on the second tape, based on the results of the detection.

Preferably, the tape printing apparatus further includes display means for displaying the first print image and the second print image area set in the area of the first print image, and at the same time specifically indicating the second print image area.

According to this preferred embodiment, it is possible to display the first print image and the second print image area and at the same time specifically indicate the second print image area (such that the second print image area can be distinguished from another area), thereby allowing the user to view or check them before printing. It should be noted that to specifically indicate the second print image area (in a distinguishable manner), the display method itself may be changed e.g. by displaying the second print image area in reverse video, or when the first print image with the second print image area being specifically indicated therein is produced, they may be displayed as they are.

Preferably, the second print image area-setting means includes area-designating means which is capable of effecting area designation for setting the second print image area in the area of the first print image displayed by the display means.

According to this preferred embodiment, the second print image area can be easily set or specified in the display means by using the area-designating means. Further, in this case, it is possible to employ various types of area-designating methods, such as a method for designating a start point and an end point by using a cursor (including a so-called cross cursor) to specify a rectangular region having a rectangular shape with a diagonal line formed by a straight line connecting the designated start point and end point, a method for designating an area by sequentially specifying respective corners of a polygonal area, and a method for designating an area by cumulatively designating dots in an area (e.g. by displaying dots having a specified resolution in reverse video, thereby designating the area indicated by black dots as a specified area).

Preferably, the second print image area-setting means includes second tape type-designating means for designating a type of the second tape from a plurality of types of tapes.

According to this preferred embodiment, since the type of the second tape can be designated from the plurality of types thereof, it is possible to produce the first print image by taking the types of tape, i.e. the width, background color, background pattern, and texture of the tape into account. Further, if the type of the second tape selected corresponds to the tape width, the second tape width as well as the width of the second print image can be set based on the type of the second tape, or alternatively if the second tape selected is of a type with a predetermined tape length, it is also possible to set the length of the second print image, thereby simplifying the setting of the second print image area.

Preferably, the second print image area-setting means includes second print image area outline-determining means for determining an outline of the second print image area.

According to this preferred embodiment, since the outline of the second print image area is determined, the second print image area having the outline can be set in the area of the first print image.

Preferably, the second print image area outline-determining means determines a line outlining a periphery of a non-transparent portion in the second print image, as an outline of the second print image area when a transparent tape is designated as the second tape.

According to this preferred embodiment, when a composite label is produced by affixing the second tape (second label) printed with the second print image onto the first print image printed on the first tape (first label), if the second tape has a transparent background, the second print image printed on the second tape appears to be formed directly on (the area of) the first print image. In this case, even if the outer periphery of the second tape (portion of the tape material of the second tape: transparent portion) overlaps the first print image, the first print image under the second tape can be seen through. Therefore, in the tape printing apparatus, a line outlining the periphery of the non-transparent portion of the second print image is determined as the outline of the second print image area. Thus, the (outline of the) second print image area, which should be taken into account when the second tape is affixed for synthesis or superposition of the image, can be set as the area of the non-transparent portion of the second print image, thereby producing a label in which the area within the first print image is effectively made use of.

Preferably, the second print image area outline-determining means determines a line indicating a contour of an area for having the second tape printed with the second print image affixed thereto, as an outline of the second print image area when a non-transparent tape is designated as the second tape.

According to this preferred embodiment, if a tape having a non-transparent background is designated as a second tape, a line indicating the outline of an area to which is to be affixed the second tape (second label) having the second print image printed thereon is determined as the outline of the second print image area. This makes it possible to set the second print image area within the area of the first print image such that the non-transparent second tape can be affixed properly with ease.

Preferably, the second print image area is set as a rectangular area containing the outline, and the second print image area outline-determining means includes at least one of length input means for inputting a length of the second print image area, and width input means for inputting a width of the second print image area.

According to this preferred embodiment, the second print image area is formed to be a rectangular area containing the outline thereof, so that the second print image area can be set basically by determining the length and width thereof. In this case, at least one of the length and width can be input. For instance, assuming that the width of the second print image area is known or determined in advance based on the type of a tape in use or that the width has been already set, by inputting the length of the area, it is possible to complete the setting of the second print image area. Further, e.g. assuming that a whole image is formed by a document image of a plurality of paragraphs, and that the whole of a predetermined one of the paragraphs is used as a second print image, by inputting the length of the paragraph in a state in which a reference point of the paragraph in the direction of the length thereof is set, it is possible to complete the setting of the second print image area. On the other hand, assuming that the length of the second print image area is known in advance based on the type of a tape in use or that the length has already been set, by setting the width of the area, it is possible to compete the settings of the second print image area. Further, for instance, assuming that a whole image is formed by a document image of one of a plurality of paragraphs or a plurality of lines of a single paragraph, and that the whole of a predetermined line is set as the second print image, by inputting the width of the line in a state in which a reference point of the line in the direction of the width thereof is set, it is possible to complete the setting of the second print image area.

Preferably, the width input means includes second tape width input means for inputting the second tape width.

According to this preferred embodiment, since the second tape width can be input, it is possible to set the width of the second print image based on the entered second tape width, by defining the relationship a between the second tape width and the width of the second print image in advance.

Preferably, the first print image-forming means includes second print image area-indicating means for providing the first print image with an area-indicating function for specifically indicating the second print image area provided as an affixing area, after printing.

According to this preferred embodiment, the first print image is provided with an area-indicating function for specifically indicating the second print image area provided as an affixing area after printing. Hence, after printing, the second print image area is specifically indicated by the area-indicating function, thereby making it possible to affix the (second label printed with the) second print image to the second print image area easily. That is, a composite label formed by synthesizing the second print image with the first print image can be produced easily.

Preferably, the second print image area is set as a polygonal area, and the second print image area-indicating means includes corner mark-arranging means for printably arranging corner marks indicating respective positions of corners of the second print image area or corner marks indicating respective positions deviated from the positions of the corners in respective predetermined directions by a predetermined distance, in the area of the first print image.

According to this preferred embodiment, the second print image area is set as a polygonal area. Therefore, it is possible to specifically indicate the second print image area by arranging corner marks which indicate the respective positions of the corners of the polygonal second print image area, in the area of the first print image. Further, the corner marks can be arranged in a manner deviated from the respective positions in one or respective predetermined direction(s). If the direction(s) of deviation and the distance of the deviation are determined in advance, the second print image area can be specifically indicated similarly to the above. Further, for instance, if the corner marks are arranged in a manner deviated outward of the area, when the (second label printed with the) second print image is affixed, the second print image is easily affixed to the second print image area in agreement with the inside of each corner mark, whereas if the corner marks are arranged in a manner deviated inward of the area, it is possible to hide the corner marks under the second print image (or the non-transparent tape material of a second label). Thus, variations are possible when a label is affixed i.e. when a composite label is produced by synthesizing images.

Preferably, the second print image area-indicating means includes outline-arranging means for printably arranging a dotted line or a solid line indicating at least one of an outline of the second print image area and an outline deviated from the outline inward by a predetermined width, in the area of the first print image.

According to this preferred embodiment, a dotted line or a solid line indicating at least one of an outline of the second print image area and an outline deviated from the outline inward by a predetermined width is arranged in the area of the first print image. Here, also when an outline formed by deviating the outline of the determined second print image area inward by a predetermined width is arranged, the area has a width determined in advance (predetermined width), and hence similarly to the former case (where the outline of the actual second print image area is arranged), it is possible to specifically indicate the second print image area. Thus, similarly to the case of the above corner marks, it is possible to design variations of the arrangement of images e.g. so as to hide the first print image under the (second label printed with the) second print image.

Preferably, the second print image area-indicating means includes second print image area color-arranging means for specifically showing a boundary dividing the second print image area and the first print image by arranging a color different from a color arranged in another area of the first print image, in one of the second print image area and an area narrower than the second print image area by a predetermined extent.

According to this preferred embodiment, a boundary dividing the second print image area and the first print image is specifically indicated, in a manner making use of the difference between colors, by arranging a color different from a color or colors arranged in another area or other areas of the first print image, in one of the second print image area and an area narrower than the second print image area by a predetermined extent. In the lather case of arranging a different color in an area slightly smaller in size (by the predetermined area) than the second print image area determined, it is possible to specifically indicate the second print image area since the area is smaller in size by the (predetermined) extent determined in advance. This makes it possible to hide the colored portion under the (the second label printed with the) second print image, similarly to the method of using corner marks and the method of using the outline of the second print image area.

The above and other objects, features, and advantages of the invention will become more apparent from the following detailed description taken in conjunction with the accompanying drawings.

DETAILED DESCRIPTION OF PREFERRED EMBODIMENTS

The invention will now be described in detail with reference to the drawings showing a tape printing apparatus according to an embodiment thereof.

Figure 1:
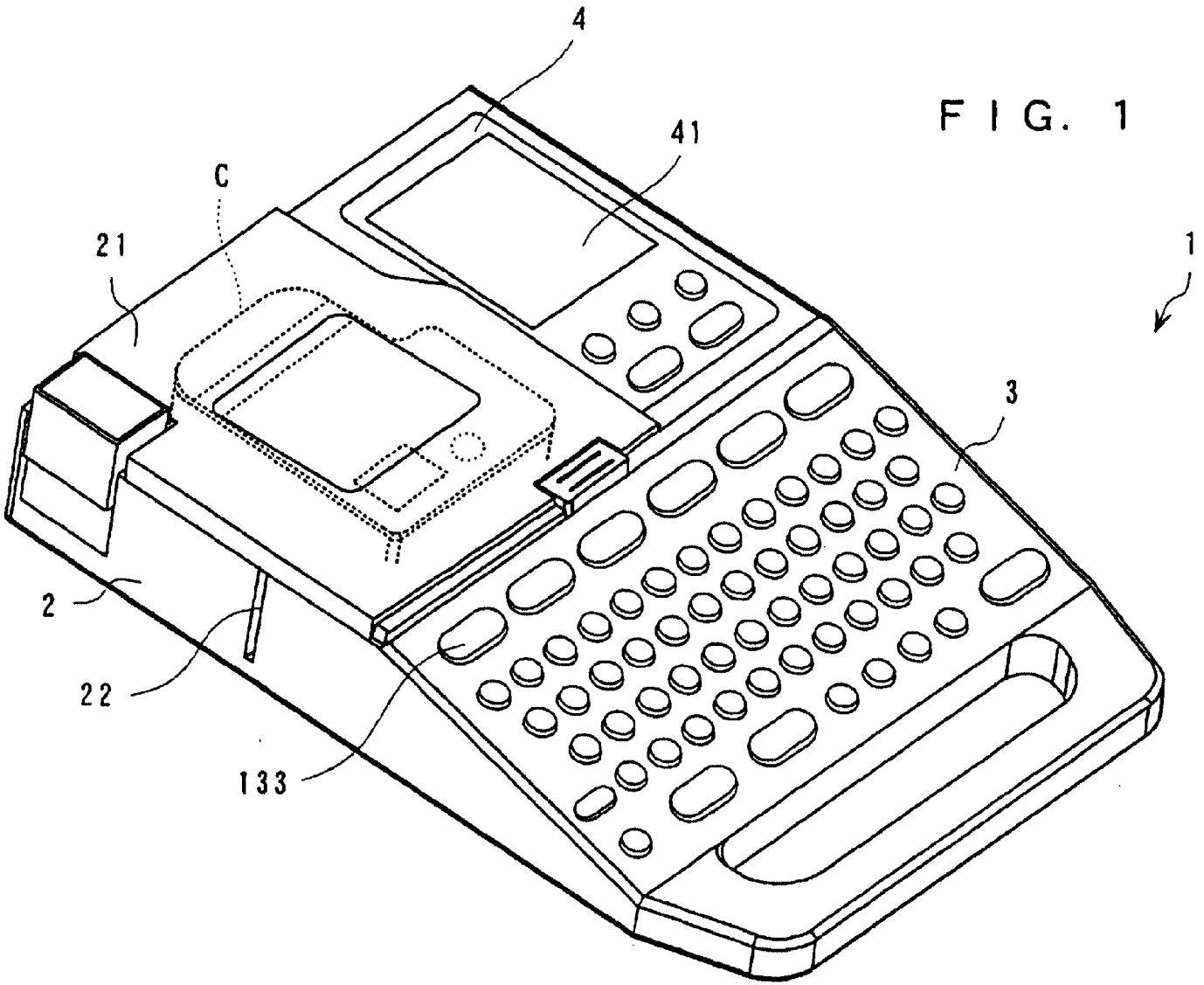
FIG. 1 is a perspective view of the appearance of a tape printing apparatus according to an embodiment of the present invention.
Figure 2:
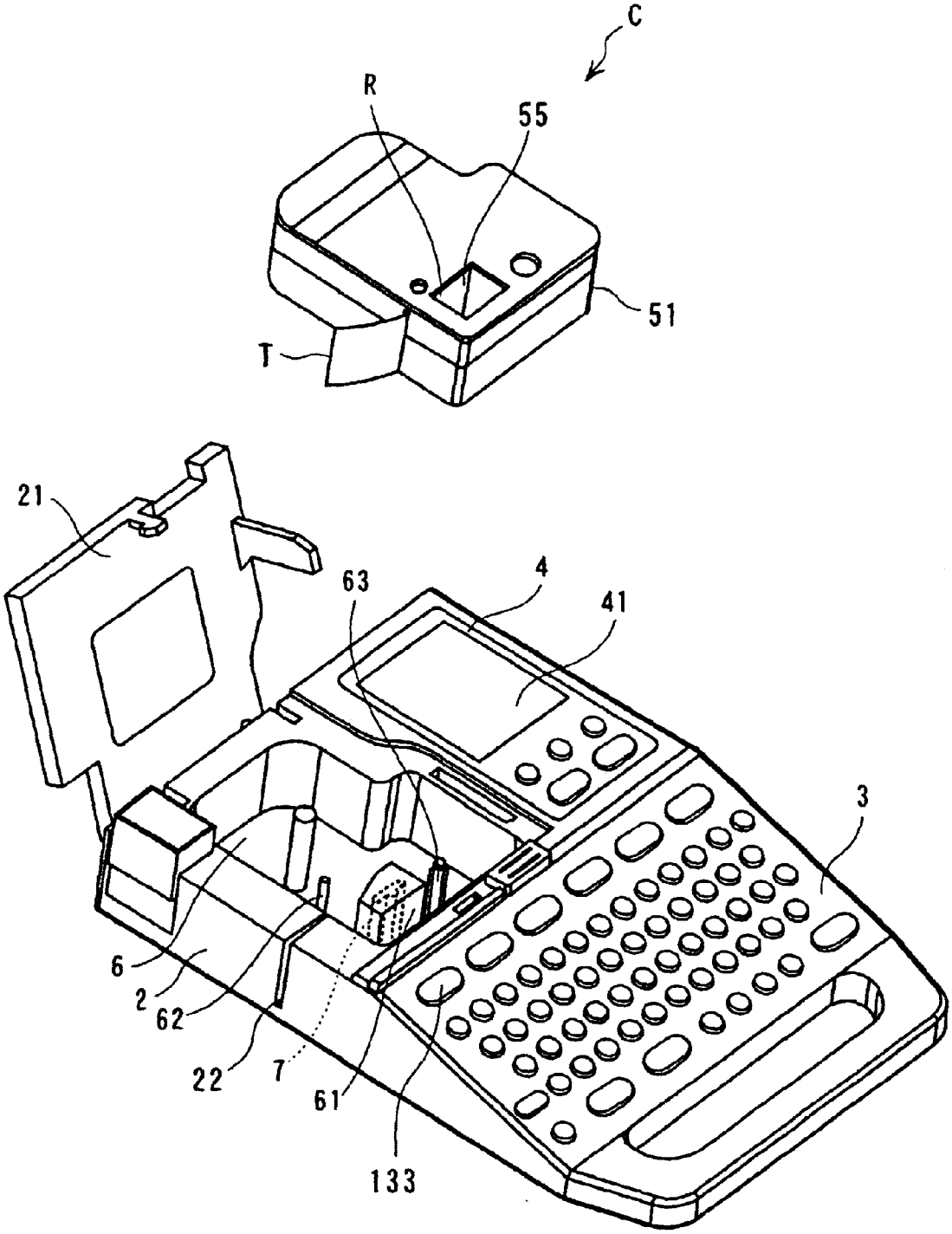
FIG. 2 is a perspective view showing the FIG. 1 tape printing apparatus with a lid thereof being open.
Figure 3:
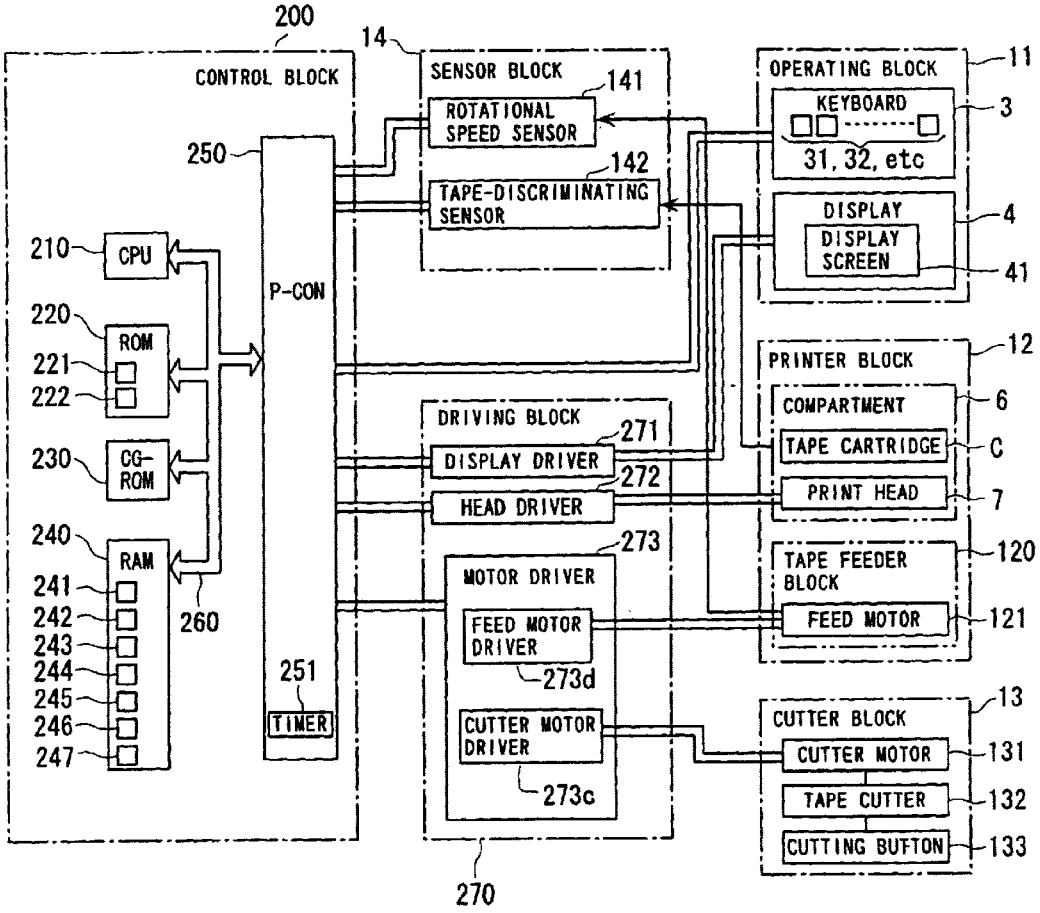
FIG. 3 is a block diagram schematically showing a control system of the FIG. 1 tape printing apparatus.

FIG. 1 shows the appearance of the whole tape printing apparatus according to the present embodiment, while FIG. 2 shows the tape printing apparatus with a lid thereof open. Further, FIG. 3 shows a control system of the tape printing apparatus. As shown in FIGS. 1 and 2, the tape printing apparatus 1 includes a casing 2 forming an outer shell thereof. The casing 2 has a keyboard 3, which is comprised of various kinds of entry keys, arranged on the top of the front portion thereof. Further, the casing 2 has a lid 21 and a display 4 arranged on the left-hand side and the right-hand side of the top of the rear portion thereof, respectively.

Further, as shown in FIG. 3, the tape printing apparatus 1 is basically comprised of an operating block 11 having the keyboard 3 and the display 4 for interfacing with the user, a printer block 12 having a print head (thermal head) 7 and a tape feeder block 120 for printing on a printing tape (hereinafter simply referred to as "the tape") T unwound from a tape cartridge C mounted in the compartment 6, a cutter block 13 for cutting off a printed portion of the tape T, a sensor block 14 having various sensors for carrying out various detecting operations, a driving block 270 having drivers for driving circuits of devices of the apparatus 1, and a control block 200 for controlling operations of blocks and devices of the apparatus 1 including the above-mentioned sensors and drivers. To implement the above construction, the casing 2 accommodates not only the above-mentioned blocks including the printer block 12, the cutter block 13, and the sensor block 14, but also a circuit board, not shown. On the circuit board are mounted a power supply unit, the circuits of the driving block 270 and the control block 200, etc. The power supply unit is connected to a connector port for connecting an AC adapter thereto, and batteries, such as nicad batteries, which can be removably mounted within the casing 2 from outside.

In the tape printing apparatus 1, after mounting the tape cartridge C in the compartment 6, the user enters printing information, such as desired characters (characters, numerals, symbols, simple figures, etc.) via the keyboard 3, while confirming or viewing the results of the entry or edit of the printing information on the display 4. Thereafter, when the user instructs the apparatus 1 to perform a printing operation via the keyboard 3, the tape feeder block 120 unwinds the tape T from the tape cartridge C, and the print head 7 prints on the tape T. The printed portion of the tape T is delivered from a tape exit 22 as the printing proceeds. When the printing is completed as desired, the tape feeder block 120 further advances the tape T until an end of a tape length (the length of a label to be formed) including the length of margins comes to a cutting position, and then stops the feeding of the tape.

As shown in FIGS. 2 and 3, the printer block 12 has the compartment 6 arranged under the lid 21 for mounting the tape cartridge C therein. The tape cartridge C can be mounted in or removed from the compartment 6 when the lid 21 is open. The tape cartridge C has a cartridge casing 51 holding a tape T having a predetermined width (within a range of approximately 4.5 to 48 mm) and an ink ribbon R. The tape cartridge C is formed with a through hole 55 for receiving therein a head unit 61 arranged in the compartment 6. Further, the tape cartridge C has a plurality of small holes formed in the bottom thereof for discrimination of the type of the tape T contained therein from the other types of the tape T having different widths, which are contained in other types of tape cartridges C. The compartment 6 has a tape-discriminating sensor 142 comprised of micro-switches or the like, for detecting the above holes to thereby determine the type of the tape T set for use.

The tape T has an adhesive surface formed on the reverse side thereof, with a peel-off paper layer covering the adhesive surface. The tape T and the ink ribbon R are fed or run such that they pass by the through hole 55, in a state overlaid upon each other, and the tape T alone is delivered out of the tape cartridge C, but the ink ribbon R is taken up into a roll within the tape cartridge C.

The head unit 61 contains the print head 7 formed by a thermal head. The print head 7 is brought into contact with the reverse side of the ink ribbon R exposed to the through hole 55 of the tape cartridge C when the tape cartridge C is mounted in the compartment 6 with the print head 7 fitted in the through hole 55. Then, by driving the print head 7 while heating the same, desired characters and the like are printed on the surface of the tape T.

Further, the casing 2 has a left side portion thereof formed with the tape exit 22 for communication between the compartment 6 and the outside of the apparatus. Opposed to the tape exit 22, there is arranged a tape cutter 132 for cutting off a delivered or dispensed portion of the tape T. Further, the compartment 6 is provided with drive shafts 62, 63 for engagement with driven portions of the tape cartridge 4 mounted in the compartment 6. A feed motor 121 as a drive source drives these drive shafts 62, 63 for rotation to feed or advance the tape T and the ink ribbon R in the tape cartridge C, and at the same time the print head 7 is driven in synchronism with the feeding of the tape and ribbon to carry out printing. Further, after completion of the printing operation, the tape T continues to be fed to bring a predetermined cutting position (corresponding to the tape length) on the tape T to the position of the tape cutter 132.

It should be noted that the feed motor 121 has an end on which is rigidly fitted a disc, not shown, formed with detection openings, and a rotational speed sensor 141 comprised of a photo sensor or the like is provided to face the path of the detection openings of the disc, for sending information of the rotational speed of the feed motor 121 detected thereby to the control block 200.

The cutter block 13 includes a tape cutter 132, a cutting button 133 for being manually operated to cause the tape cutter 132 to cut the tape T when a desired length printing is carried out, for instance, and a cutter motor 131 for automatically driving the tape cutter 132 to cut the tape T when a fixed length printing is carried out, for instance. To selectively carry out one of the two cutting operations, the tape printing apparatus 1 is capable of being switched between a manual cutting mode and an automatic cutting mode by a mode-setting operation. Therefore, in the manual cutting mode, when the printing operation is completed, the user pushes the cutting button 133 arranged on the casing 2, whereby the tape cutter 132 is actuated to cut the tape T to a desired length. On the other hand, in the automatic cutting mode, after completion of the printing operation, the tape T is sent further by the length of a rear margin, and then stopped, whereupon the cutter motor 131 is driven to cut off the tape T.

The sensor block 14 includes the rotational speed sensor 141, and the tape-discriminating sensor 142. It should be noted that the above sensors can be omitted to suit the actual requirements of the tape printing apparatus.

The driving block 270 includes a display driver 271, a head driver 272, and a motor driver 273. The display driver 271 drives the display 4 of the operating block 11 in response to control signals delivered from the control block 200, i.e. in accordance with commands carried by the signals. Similarly, the head driver 272 drives the print head 7 of the printer block 12 in accordance with commands from the control block 200. Further, the motor driver 273 includes a feed motor driver 273*d* for driving the feed motor 121 of the printer block 12, and a cutter motor driver 273*c* for driving the cutter motor 131 of the cutter block 13, and similarly to the display driver 271 and the head driver 272, drives each motor in accordance with commands from the control block 200.

The operating block 11 includes the keyboard 3 and the display 4. The display 4 has a display screen 41 which is capable of displaying display image data of 96×64 dots on a rectangular display area of approximately 6 cm in the horizontal direction (X direction)×4 cm in the vertical direction (Y direction). The display 4 is used by the user when he enters data via the keyboard 3 to form or edit print image data, such as literal string image data, and check the result of the entry, or enters instructions or commands via the keyboard 3.

On the keyboard 3, there are arranged a character key group 31 including an alphabet key group, a number key group, and a nonstandard character key group for calling nonstandard characters for selection, as well as a function key group 32 for designating various operation modes and the like. In a type of apparatus which is capable of entering the Japanese language, the character key group 31 includes a kana key group for entering Japanese hiragana characters and Japanese katakana letters.

The function key group 32 includes a "print" key for instructing execution of a printing operation as well as a "selection" key for selecting options displayed on the display screen 41 when kana-kanji conversion (in the case of a Japanese language-adapted type of the apparatus) and other functions are to be selected, a "deletion" key for deleting a character at a cursor position and canceling the operation of functions during performance of the functions, and "cursor" keys (up arrow key, down arrow key, left arrow key, and right arrow key) for moving a cursor K representing the position of a character next to be input or a position where a function next to be operated is displayed.

The function key group 32 further includes a tape shift key, referred to hereinafter, for use in instructing the shift or replacement of a tape T, an enclosing box instruction (enclosing box) key for use in instructing formation of an enclosing box, a paragraph break insertion key for use in instructing arrangement (insertion) of a new paragraph, and a new line start key for use in instructing the starting of a new line, and the like.

Of course, similarly to keyboards of the general type, the above-mentioned key entries may be made by the respective keys exclusively provided therefor or by a smaller number of keys operated in combination with the shift key and/or the like. As shown in FIG. 3, by using the keyboard 3, various commands and data are input to the control block 200.

The control block 200 includes a CPU 210, a ROM 220, a character generator ROM (CG-ROM) 230, a RAM 240, a peripheral control circuit (P-CON) 250, all of which are connected to each other by an internal bus 260. The ROM 220 has a control program area 221 for storing control programs executed by the CPU 210 as well as a control data area 222 for storing control data including a color conversion table, and a character modification table. The CG-ROM 230 stores font data (mainly outline font, partially including bit map data) of pictographs, symbols, figures and the like, provided for the tape printing apparatus 1. When code data for identifying a character or the like is input thereto, it outputs font data corresponding to the code data.

The RAM 240 is supplied with power by a backup circuit, not shown, such that stored data can be preserved even after the power is turned off by operating a power key. The RAM 240 includes areas of a register group 241, a text data area 242 for storing text data of characters or the like input by the user via the keyboard 3, a display image data area 243 for storing image data displayed on the display screen 41, a print image data area 244 for storing print image data, a registered image data area 245 for storing registered image data, as well as a print record data area 246 and conversion buffer areas 247 including a color conversion buffer. The RAM 240 is used as a work area for carrying out the control process.

The P-CON 250 incorporates logic circuits for complementing the functions of the CPU 210 as well as dealing with interface signals for interfacing between the CPU 210 and peripheral circuits. The logic circuits are implemented by gate arrays, a custom LSI and the like. For instance, a timer 251 is also incorporated in the P-CON 250 for the function of measuring elapsed time. To perform its functions, the P-CON 250 is connected to the sensors of the sensor block 14 and the keyboard 3, for receiving the above-mentioned signals generated by the sensor block 14 as well as commands and data input via the keyboard 3, and inputting these to the internal bus 260 directly or after processing them. Further, the P-CON 250 cooperates with the CPU 210 to output data and control signals input to the internal bus 260 by the CPU 210 or the like, to the driving block 270 directly or after processing them.

The CPU 210 of the control block 200 receives the signals from the sensor block 14, and the commands and data input via the keyboard 3 via the P-CON 250, according to the control program read from the ROM 220, processes font data from the CG-ROM 230 and various data stored in the RAM 240, and delivers control signals to the driving block 270 via the P-CON 250 to thereby carry out position control during printing operations, display control of the display screen 41, and printing control of the print head 7 to carry out printing on the tape T under predetermined printing conditions. In short, the CPU 210 controls the overall operation of the tape printing apparatus 1.

In the present embodiment, a label producing method is employed which is capable of integrally using a plurality of types of tapes which are different in width, background color, background pattern, texture, and so forth, thereby producing diversified and attractive labels. In the following, the label producing method will be describe in detail. In this label producing method, basically, a first print image is printed on a first tape to produce a first label, a second print image is printed on a second tape to produce a second label, and the second label is affixed to the first label, whereby the second print image is synthesized with the first print image to produce a composite label including the synthetic image.

Figure 4A:
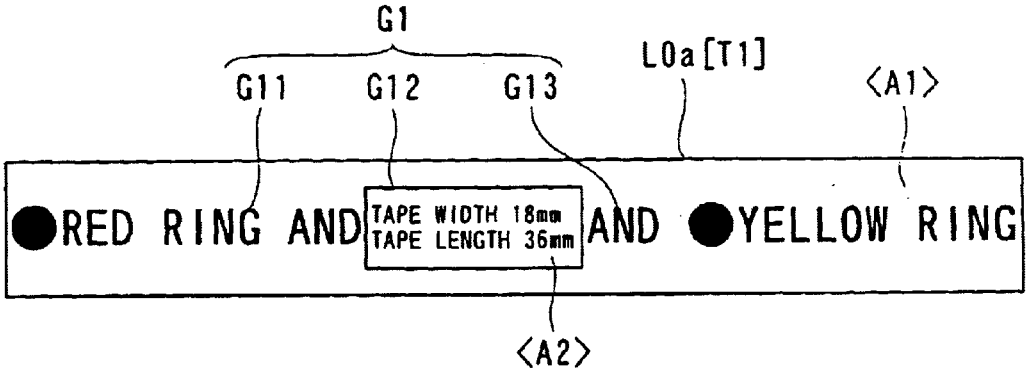
FIGS. 4A to 4D are diagrams showing examples of print images and a label formed based the print images.
Figure 4B:
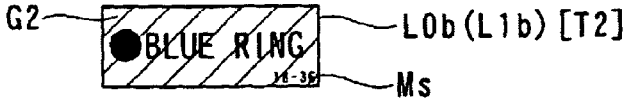
Figure 4C:
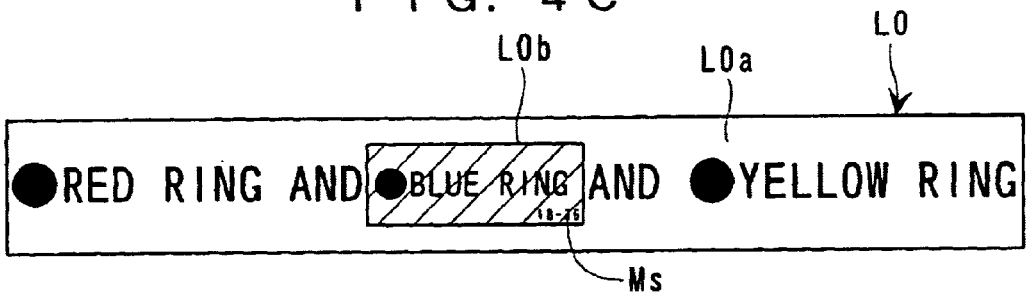

For instance, when a composite label L0 shown in FIG. 4C is produced, a tape, shown in FIG. 4A, having a tape width (first tape width) of 24 mm with a white background is set to a first tape T1, a tape, shown in FIG. 4B, having a tape width (second tape width) of 18 mm with a light blue background is set to a second tape T2, and a first print image G1 is printed on the first tape T1 to produce a first label L0*a*, while a second print image G2 is printed on the second tape T2 to produce a second label L0*b*. After that, the second label L0*b* is affixed to the first label L0*a*, whereby the second print image G2 is synthesized with the first print image G1 in a manner superposed onto a second print image area A2 thereof to produce the composite label L0 including the synthetic image.

In the above process, when the first print image G1 is formed, the second print image G2 of the second label L0*b* to be affixed to (synthesized with) the first print image G1 is taken into account. More specifically, the label producing method of the present embodiment is also characterized by an image forming method of forming the first print image G1. As shown in FIG. 4A, the first print image G1 is composed of a literal string image G11 of "● RED RING AND", a contour image G12 indicating the outline of the rectangular area A2, and a literal string G13 of "AND ● YELLOW RING". The contour image G12 in this example is a mark image for specifically indicating an affixing area (second print image area) A2 to which the second print image G2 of the second label L0*b* is to be affixed. When the first print image G1 is formed, the second print image area A2 is set so as to assign the area to the second prints image G2, and the first print image G1 having the second print image area A2 specifically indicated as the contour image G12 is formed for printing.

To set the second print image area A2, various procedures can be employed in a manner suited to respective situations, and hence in the tape printing apparatus 1, to make available as many procedures as possible, the tape shift key is provided for issuing a tape shift instruction for shifting the apparatus from a first tape edit mode for editing the first print image G1 to be printed on the first tape T1 to a second a tape edit mode for editing the second print image G2 to be printed on the second tape T2, and based on the edited state of the first print image G1 at a time point of the tape shift key being operated (depressed: tape shift instruction), the second print image area A2 is set. Therefore, by depressing the tape shift key (issuing the tape shift instruction) in view of the edited state of the first print image G1, the apparatus can be switched to the second tape edit mode and various second print image areas A2 can be set.

In the case of the example described above with reference to FIGS. 4A to 4D, first, the user mounts (the tape cartridge C containing) the first tape T1 having the first tape width of 24 mm with the white background in the tape printing apparatus 1, enters, for instance, the literal string "● RED RING AND AND ● YELLOW RING" first, and then specifies a location between the literal string "● RED RING AND" and the character string "AND ● YELLOW RING" by using the cursor to place the location in a character insertion mode. After that, by depressing the tape shift key, the user can switch the apparatus to the second tape edit mode to enter (edit) a literal string "● BLUE RING" used in the second print image G2. In the tape printing apparatus 1, when the tape shift key is depressed, new options of tape widths equal to or smaller than the tape width (first tape width) of the first tape T1 whose type has been detected are displayed on the display screen 41 of the display 4 as candidates for the tape width (second tape width) of the second tape T2, and hence the user can select and designate any of the tape widths.

In the above example, now, it is only required to select the tape width of 18 mm. Further, after selection (designation) of the second tape width has been finished, the user can input the numerical value of the tape length of the second tape since the tape printing apparatus 1 displays a screen which prompts him to enter the tape length. The user can switch the apparatus to the second tape edit mode by depressing the tape shift key, select (designate) the second tape width, input the second tape length (36 mm in the example illustrated in the figures), enter the literal string "● BLUE RING" for the second print image G2, and then by depressing the tape shift key again, cancel the second tape edit mode to restore the apparatus to the first tape edit mode.

The user can display the whole print image (synthetic image formed by synthesizing the second print image G2 with the first print image G1 in the second print image area A2 of the first print image G1) including the second print image G2 on the display screen 41 of the display 4, and edit the whole print image (synthetic image). Further, by operating (depressing) the print key after editing the whole print image, the user can print the above first print image G1 on the first tape T1 to produce the first label L0*a*. Next, the user mounts the second tape T2, which has the second tape width of 18 mm and the light blue background, in the tape printing apparatus 1, switches the apparatus to the second tape edit mode by depressing the tape shift key, and depresses the print key, whereby the user can print the above second print image G2 on the second tape T2 to produce the second label L0*b*. Then, the user can produce the composite label L0 by affixing the second print image G2 of the second label L0*b* onto the second print image area A2 of the first print image G1 on the first label L0*a*.

It should be noted that when the first print image G1 is printed, the user may print the size information thereof (e.g. the width and length thereof as shown in FIG. 4A) such that not only the contour but also detailed sizes thereof can be specifically shown. Further, since the type of a tape mounted as the second tape T2 can be detected, it is possible to confirm that the first tape has been replaced so as to print the second print image on the second tape, based on the results of the detection. In this case, the apparatus may be configured such that if the tape mounted as the second tape T2 is different from a tape selected as the second tape T2, the user is notified of the error.

As described hereinabove, according to the label producing method employed in the present embodiment, it is possible to select different types of tapes as the first tape T1 and the second tape T2 from various types of tapes as well as to edit and produce the first print image G1 and the second print image G2 in view of the difference between the tapes in use. This makes it possible to integrally use a plurality of types of tapes which are different in width, background color, background pattern, texture, and so forth, thereby producing the diversified and attractive composite label L0.

Further, in the present embodiment, the tape printing apparatus 1 for producing the first label L0*a* is identical to the tape printing apparatus 1 for producing the second label L0*b*, so that it is possible not only to print the first print image G1 on the first tape T1 by using the same tape printing apparatus 1 to produce the first label L0*a* but also to produce the second label L0*b* printed with the second print image G2. Then, by affixing the second label L0*b* to the first label L0*a*, the composite label L0 can be produced.

Further, since the first tape T1 mounted in the apparatus is replaced with the second tape T2 after the first label L0*a* has been produced, the production of the first label L0*a* and the production of the second label L0*b* are carried out in successive steps which means only one pair of tape-mounting means and printing means are necessitated at a time. Therefore, if the same pair of means are commonly used for mounting two types of tapes and printing on the tapes, the one pair of means can serve the whole purpose. Further, since the second print image G2 is formed before the process of replacing tapes is carried out, it is possible to form the second print image G2 prior to operation (work) for replacing the tape, or the like. Hence, the second print image G2 can be formed after producing the first print image G1 without a long interval, which makes it easy to form the second print image G2. Further, since the synthetic image can be displayed which is formed by synthesizing the second print image G2 with the first print image G1 in the second print image area A2 of the first print image G1, it is possible to confirm or check the whole image (synthetic image) by displaying it on the display screen 41, without actually producing the above labels (first label, second label, synthetic label). As a result, the check (display) can be performed before producing the first label L0*a* and the second label L0*b*. This makes it possible to reduce the waste of producing a label (tape) having an undesired synthetic image printed thereon, and print the whole image to produce a label after re-editing and confirming the resulting image again.

As described hereinbefore, the label producing method according to the present embodiment is also characterized by the image forming method of forming the first print image G1. Particularly, it is characterized in that the second print image area A2 which corresponds to the second tape T2 having the second tape width equal to or smaller than the first tape width is set in the region of the first print image G1, and the first print image G1 having the area A2 provided therein is formed. Therefore, by printing the first print image G1 on the first tape T1, a portion printed with the image G1 can be set to the first label L0*a*, and the second label L0*b* formed by another tape (second tape) T2 printed with the second print image A2 can be affixed onto (the second print image area A2 of the first print image G1 of) the first label L0*a*, to thereby produce a new label (composite label) L0 (as a result of synthesis by affixation of the second label L0*b*).

In this embodiment, a tape T different in type from the first tape T1 can be selected from various types of tapes T as the second tape T2, so that it is possible to edit and produce the first print image G1 in view of the difference between the tapes T1 and T2. This makes it possible to integrally use a plurality of types of tapes which are different in width, background color, background pattern, texture, and so forth, and thereby produce the diversified and attractive composite label L0. Further, if the second print image G2 to be printed on the second tape T2 is formed and printed similarly to the first print image G1 printed on the first tape T1, it is possible to synthesize a third print image printed on still another tape with the second print image G2 on the second tape T2, i.e. affixing the third label onto an area in the second print image area (see FIGS. 9A to 10D).

The procedure described above with reference to FIGS. 4A to 4D as the procedure for setting the second print image area A2 is, so to speak, (1) "Procedure of inserting a second print image (area) after forming the whole of a first print image except the second print image" (hereinafter referred to as "Procedure of inserting a second print image (area)"). Additionally, there is provided (2) "Procedure of forming a second print image (after providing a second print image area) when the portion of the second print image is to be produced in the course of forming a first print image, and then resuming the forming of the remaining portion of the first print image" (hereinafter referred to as "Procedure of forming a second print image (by securing a second print image area) in the course of forming a first print image)".

More specifically, in the former (1) "Procedure of inserting a second print image (area)", the literal string "● RED RING AND AND ● YELLOW RING" is input, and then the second print image area A2 is assigned to the second print image such that the literal string "●BLUE RING" can be inserted between the literal strings "● RED RING AND" and "AND ● YELLOW RING", followed by inputting the literal string "● BLUE RING" used in the second print image G2. On the other hand, in the latter (2) "Procedure of forming a second print image (after providing a second print image area) in the course of forming a first print image", the apparatus is switched to the second tape edit mode by operating the tape shift key when the literal string "● RED RING AND" has been entered, and the second print image area A2 is assigned to the second print image to input the literal string "● BLUE RING" used in the second print image G2. Then, the literal string "AND ● YELLOW RING"is input after the apparatus is restored to the first tape edit mode (tape shift mode is cancelled) by depressing the tape shift key.

Further, in the above (1) "Procedure of inserting a second print image (area)" and (2) "Procedure of forming a second print image (after providing a second print image area) in the course of forming a first print image", the second print image G2 may be formed after the second print image area A2 has been assigned by inputting the width and length thereof, or alternatively the second print image G2 may be formed first, and then an area corresponding thereto may be provided or assigned to the second print image area A2. Further, in the above cases, it is also possible to secure only the second print image area A2 (i.e. assign an area to the second print image) for the time being, to enable the second print image G2 to be formed after mounting the second tape (replacement of the first tape). Further, to this end, respective separate tape printing apparatuses can be used to produce the first label L0*a* and the second label L0*b*.

To form the second print image G2 before securing the second print image area A2, there is further provided (3) "Procedure of forming a whole image (equivalent to a synthetic image) including a second print image while specifying part thereof as a range for the second print image (area) (hereinafter referred to as "procedure of designating a range for a second print image (area)". More specifically, in the example illustrated in FIGS. 4A to 4D, it is also possible to designate the range of the characters "● BLUE RING" by operating the cursor after inputting the characters "● RED RING AND ● BLUE RING AND ● YELLOW RING", and depress the tape shift key, thereby setting the characters "● BLUE RING" to the second print image G2 and the area thereof to the second print image area A2.

The designation of a range of characters and the tape shift instruction (tape shift key depression) may be simultaneously carried out, e.g. by moving the cursor to designate the range of the characters while keeping the tape shift key depressed. Further, the range of the characters may be designated before the tape shift instruction is issued, the tape shift instruction may be issued before the range of the characters is designated, or whether the range of the characters is designated first or the tape shift instruction is issued first may be selected as desired. In the above cases, when designation of the range of the characters (literal string range designation) and operation of the tape shift key for issuing the tape shift instruction are carried out simultaneously or in a predetermined sequence, the designated range of the literal string (the range of the characters "● BLUE RING" in the above example) is set to the second print image area A2, and hence it is possible through the above cursor and key operations to shift the apparatus to the second tape edit mode and set the second print image area (area of a literal string in the designated range) A2, thereby producing (a first print image for) a (composite) label appearing to be provided with an attractive literal string-enclosing box (character-enclosing box). It should be noted that the range of characters is designated e.g. by so-called drag operation by operating the cursor or the like, or by specifying a start point (first character of a literal string) and an end point (last character of the literal string).

Further, when the second print image area A2 is provided or secured first or when the second print image G2 is formed before the second print image area A2 is provided, so long as the second print image G2 is a literal string image, the width of the area (or second tape width) and the height of each character are related to each other, and the length of the area and the length of the literal string (the number of the characters) are related to each other. Hence, in the tape printing apparatus 1, in the second tape edit mode, the size of characters in the second print image G2 is determined after the second print image area A2 has been provided and the second print image G2 has been input and when the apparatus is restored to the first tape edit mode (at the time point of cancellation of tape shift). Therefore, it is possible to adjust the size of characters in the first print image G1 based on the determined character size of the second print image G2.

Figure 4D:
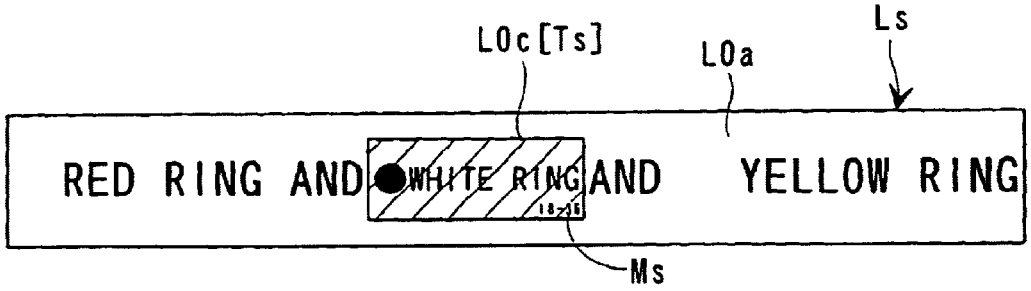
Figure 5A:
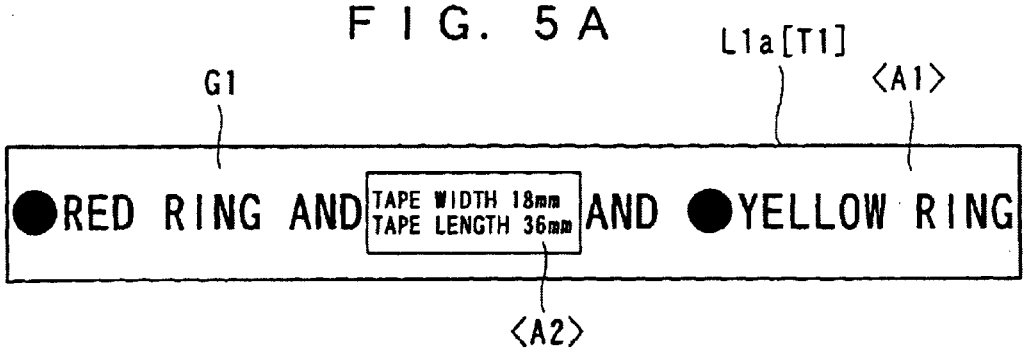
FIGS. 5A to 5D are diagrams similar to FIGS. 4A to 4D, which illustrate another example.
Figure 5B:
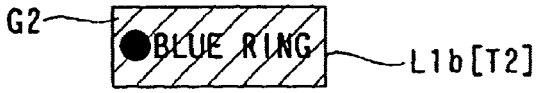
Figure 5C:
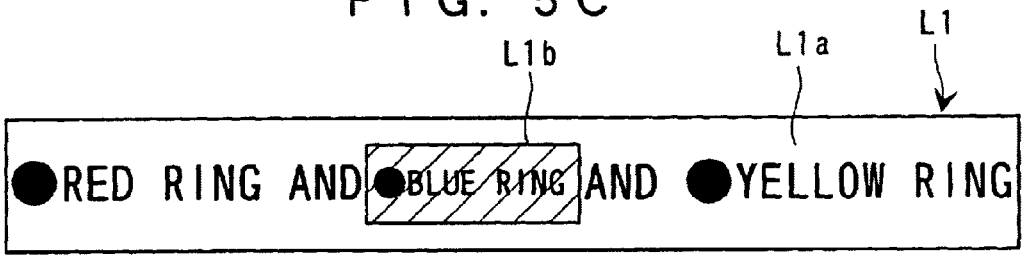

For instance, in a case similar to the example described above with reference to FIGS. 4A to 4D, as shown in FIGS. 5A to 5C, a first print image G1 is formed whose character size is adjusted according to the character size of the literal string "● BLUE RING" of the second print image G2. Then, the first print image G1 is printed on the first tape T1 to set the same to a first label L1*a* (see FIG. 5A), and the second print image G2 is printed on the second tape T2 to set the same to a second label L1*b* (see FIG. 5B). The second label L1*b* is affixed to the second print image area A2 of the first label L1*a* in a manner adapted thereto. This makes it possible to produce a composite label L1 with a synthetic image formed by synthesizing the second print image G2 with the first print image G1. In this case, as shown in FIG. 5C, the composite label L1 with its character sizes being adjusted (to the same size in the illustrated example) can be produced. More specifically, since the character size of the second print image G2 is determined in the second tape edit mode, and based on the determined character size, the character size of the first print image G1 is adjusted, so that when the (second label L1*b* printed with the) second print image G2 is affixed, the character size of the second print image G2 and the character size of the first print image G1 can be well-balanced, thereby enabling the composite label L1 produced by affixation to be made attractive.

Figure 5D:
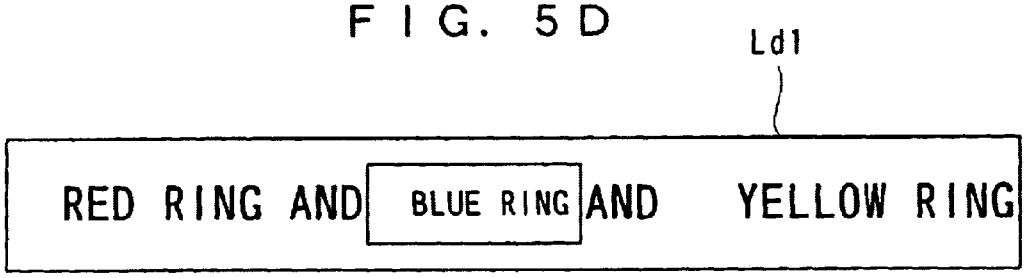

In the image forming method described above with reference to FIGS. 4A to 4D and FIGS. 5A to 5D, the first print image G1 is set to have a literal string including a plurality of characters, and the second print image area A2 is set to bear at least part ("● BLUE RING" in the above example) of the literal string when the second print image G2 is affixed thereto. Accordingly, by printing the first print image G1 on the first tape T1, and the second print image G2 on the second tape T2 different from the first tape T1 in width, background color, background pattern, texture, followed by affixing the same to the second print image area A2 (synthesizing the same with the first print image G1), it is possible to assign at least part of a literal string to the second print image G2. This makes it possible to produce (the first print image G1 for) an attractive (composite) label L0 or L1 appearing to be provided with a literal string-enclosing box (character-enclosing box). More specifically, FIG. 5D shows a label Ld1 produced by using the conventional function of "enclosing character in a box". On the other hand, according to the image forming method and label producing method described above, as shown in FIG. 5C, it is possible to produce a (composite) label L1 with a more attractive character-enclosing box by deliberately selecting a type of the second label L1*b* (in respect of width, background color, background pattern, texture, etc.).

Although in the above examples, the literal string "● BLUE RING" is used as the second print image G2, and the area thereof is used as the second print image area A2, it goes without saying that the second print image may be formed by only one character, such as only the character "●", only the character "R" (of the "RING"), and so forth, or by a plurality of discontinuous characters, such as the three characters "●", the three characters "R's", or the three portions indicating colors of "RED", "YELLOW", and "BLUE", out of the literal string "● RED RING AND ● BLUE RING AND ● YELLOW RING". Further, for instance, if the second tape T2 has a non-transparent background color, separate labels (three second labels) with the plurality of discontinuous characters (here, the three characters "●" are used by way of example) printed thereon respectively may be produced and affixed to their respective areas, whereby it is possible to cope with the non-transparent color. On the other hand, when the second tape T2 having a transparent color is to be formed into a second label, the plurality of discontinuous characters (discontinuous characters "●") may be printed on the second tape T2 to form a second label and affix the second label (synthesize the second images with the first print image) without further processing.

Also when a single character or a plurality of discontinuous characters are designated, similarly to the above case of the literal string, any of (1) to (3) Procedures may be employed. If (1) "Procedure of inserting a second print image (area)" is employed, the three characters "●", for instance, are inserted after the characters "RED RING AND BLUE RING AND YELLOW RING" is input. If (2) "Procedure of forming a second print image (after providing a second print image area) in the course of forming a first print image" is employed, the character "●", for instance, is entered in the second tape edit mode, the literal string "RED RING AND" is input, after shifting to the first tape edit mode, the character "●" is entered after shifting to the second tape edit mode, the literal string "BLUE RING AND" is input after shifting to the first tape edit mode, the character "●" is entered after shifting to the second tape edit mode, and the literal string "YELLOW RING" is input after shifting to the first tape edit mode.

Further, if (3) "Procedure of designating the range of a second print image (area)" is employed, the three characters "●" are designated by operating the cursor or the like after entry of the characters "● RED RING AND ● BLUE RING AND ● YELLOW RING". In this case as well, characters may be designated first, tape shift may be instructed first, or the apparatus may be constructed such that either of designation of characters and the tape shift instruction can be selected as desired. In these cases, it is possible to carry out designation of characters so as to designate one or more characters in the first print image G1, and when designation of characters and operation of the tape shift key for providing the tape shift instruction are carried out simultaneously or in a predetermined sequence, the designated range of the characters is set to the second print image area A2, and hence it is possible through the cursor and key operations to shift the apparatus to the second tape edit mode and set the second print image area (area of characters in the designated range) A2.

According to the image forming method in the above example, the first print image G1 is set to have a plurality of characters, and the second print image area A2 is set to bear at least one of the plurality of characters when the second print image G2 is affixed thereto. Accordingly, the first print image G1 is printed on the first tape T1, while the second print image G2 is printed on the second tape T2 different from the first tape T1 in width, background color, background pattern, texture, and so forth, to affix (synthesize) the same on the second print image area A2, whereby it is possible to assign at least one character to the second print image G2. This makes it possible to produce (a first print image for) a (composite) label appearing to be provided with an attractive character-enclosing box.

Similarly to the example described above with reference to FIGS. 5A to 5D, in this example as well, in the tape printing apparatus 1, in the second tape edit mode, the character size of the second print image G2 is determined after the second print image area A2 has been provided and the second print image G2 has been input and when the apparatus is restored to the first tape edit mode (at the time point of cancellation of tape shift). Therefore, it is also possible to adjust the size of characters in the first print image G1 based on the determined character size of the second print image G2, and when the second label L1*b* printed with the second print image G2 is affixed, the character size of the second print image G2 and the character size of the first print image G1 can be well-balanced, thereby enabling the composite label L1 produced by affixation to be made attractive.

Further, as described above in each of the examples, the tape printing apparatus 1 is configured such that by operation (depression) of the tape shift key, the tape edit mode can be repeatedly shifted in a manner such that the first tape edit mode→the second tape edit mode (cancellation of tape shift)→the first tape edit mode→the second tape edit mode (cancellation of tape shift)→the first tape edit mode→. . . , so that even if the apparatus is shifted to the second tape edit mode once, it is possible to cancel the second tape edit mode (cancel tape shift) at a desired time point to restore the apparatus to the first tape edit mode. Further, in this embodiment, the tape shift cancellation instruction is issued through the same operation (depression of the tape shift key) as carried out in issuing the instruction of tape shift. Hence, it is possible to shift the apparatus between the first tape edit mode and the second tape edit mode simply by carrying out the same key operation, i.e. whenever the tape shift key is depressed. In addition, the apparatus can be configured to perform automatic cancellation (automatic tape shift cancellation) after the second print image area has been set. Further, the apparatus may be configured such that whether the tape edit mode is switched by the same key operation or the automatic cancellation is performed can be selected as desired, or automatically selected depending on a edited state of the first print image before the tape shift is effected.

Although in the above example, only the portion "● BLUE RING" of the literal string "●RED RING AND ● BLUE RING AND ● YELLOW RING" is set to the second print image G2, and the area of the portion is set to the second print image area A2, this is not limitative, but the whole of the literal string "● RED RING AND ● BLUE RING AND ● YELLOW RING" may be set to the second print image G2. In this case, there is no image in any portions except for the second print image, so that if the second tape T2 is non-transparent, the contour of the second tape T2 serves as an enclosing box.

Figure 6A:
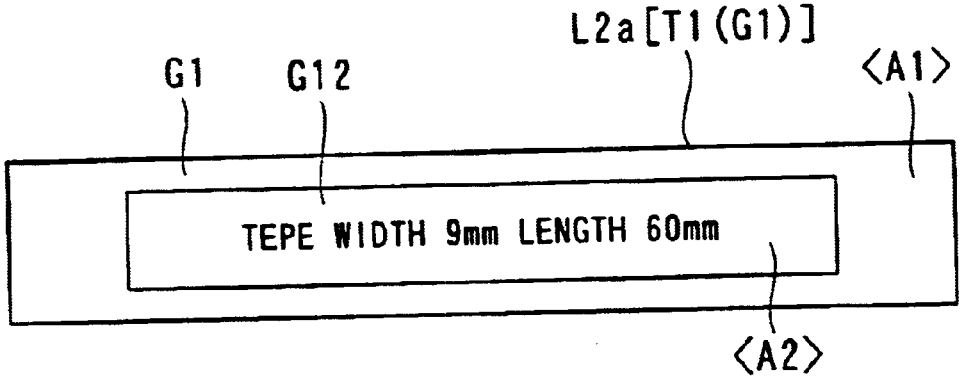
FIGS. 6A to 6D are diagrams similar to FIGS. 4A to 4D, which illustrate still another example.
Figure 6B:
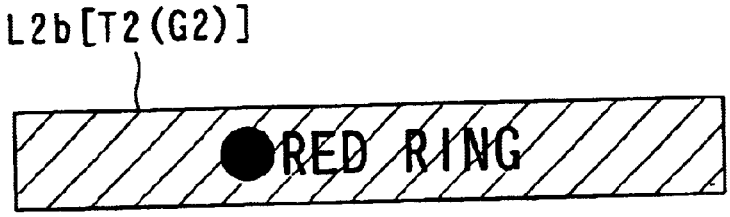
Figure 6C:
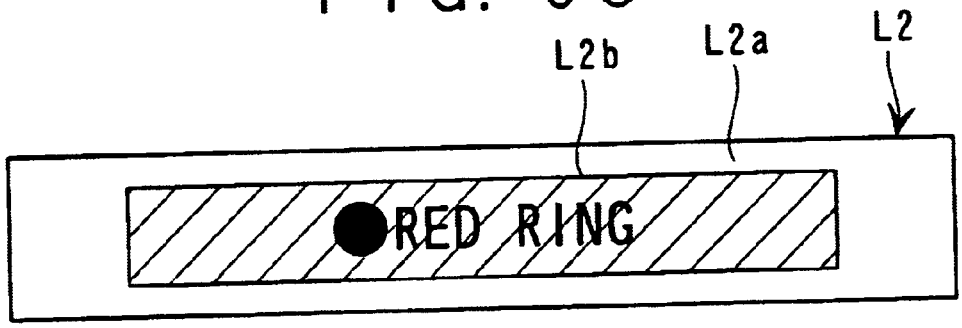
Figure 6D:
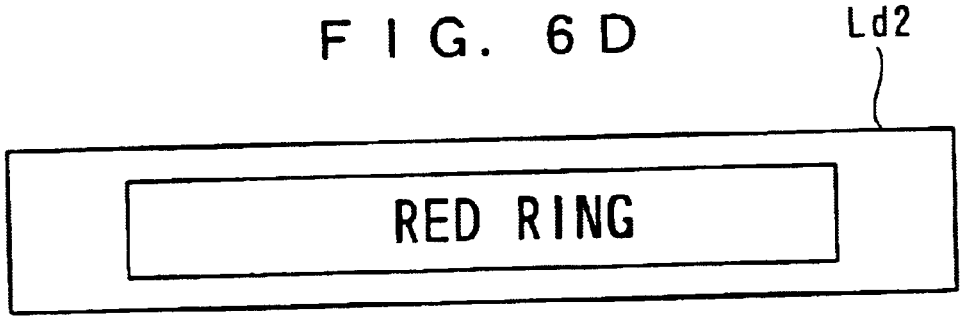

For instance, if a literal string shorter than the illustrated literal string is used by way of example, with (the whole of) the literal string being formed by the literal string "● RED RING" and the whole literal string being set to a second print image G2, and if a first tape T1 which has a first tape width of 12 mm with a white background for use with black characters (black ink ribbon R: black ink tape cartridge C), and a second tape T2 which has a second tape width of 9 mm with a green background for use with red characters (tape cartridge C containing a set of a green tape T and a red ink ribbon R) are employed, a composite label L2 as shown in FIG. 6C can be produced. More specifically, FIG. 6D shows a label Ld2 produced by using the conventional "enclosing box" function. On the other hand, according to the image forming method and label producing method in this example, as shown in FIG. 6C, it is possible to produce a (composite) label L1 with a more attractive "enclosing box" by deliberately selecting a type of the second label L2*b* (in respect of width, background color, background pattern, texture, etc.).

In the case of the example of the enclosing box, since there is no image in any portions except for the second print image G2, the print image G1 is formed by only the contour image G12 showing the outline of the second print image area A2. Therefore, a procedure corresponding to any of the (1) to (3) Procedures, that is, (1) "Procedure of inserting a second print image (area)", (2) "Procedure of forming a second print image (after providing a second print image area) in the course of forming a first print image", and (3) "Procedure of designating the range of a second print image (area)" is either of (i) "Procedure of forming a second print image after providing a second print image area", and (ii) "Procedure of forming a second print image to set and secure a second print image area after forming the same". More specifically, by operating an enclosing box instruction key (enclosing box key) and the tape shift key, a "second tape box" ("replaced-tape box") is instructed to realize a decoration equivalent to a so-called enclosing box or one with more excellent appearance by the contour of another tape (second tape) affixed to the second print image area. Also in the case of this function being exhibited, the enclosing box key and the tape shift key may be operated at the same time, or the tape shift key may be operated after or before the enclosing box key is operated, without defining the sequence, i.e. order of key operations.

For instance, in the above (i) Procedure, first, the enclosing box key and the tape shift key are operated simultaneously or in a predetermined sequence to instruct the second tape box, and then a second print image area A2 is set by selecting (instructing) the tape width of the area and inputting the length thereof. After that, the literal string "● RED RING"is input to form a second print image G2. On the other hand, in the (ii) Procedure, after inputting the literal string "● RED RING" to form the second print image G2, the second tape box is instructed, and thereafter a second print image area A2 is set by designating the tape width and length of the area. In these cases, after that (from a state in which the first tape T1 is mounted), the first print image G1 (contour image G12) is printed on the first tape T1 by depressing the print key to form a first label L2*a* (see FIG. 6A). Then, the second tape T2 is mounted (the first tape is replaced), and after shifting the apparatus to the second tape edit mode by depressing the tape shift key, the second print image G2 is printed on the second tape T2 by depressing the print key, thereby making it possible to form a second label L2*b* (see FIG. 6B). The second print image G2 of the second label L2*b* can be affixed to (the contour image G12 in) the second print image area A2 of the first label L2*a,* whereby a composite label L2 can be produced.

As described above, in the tape printing apparatus 1 according to the present embodiment, it is possible to operate the enclosing box key (for issuing the enclosing box instruction) for instructing that the first print image G1 should be formed into an image with an enclosing box. When the enclosing box key for issuing the enclosing box instruction and the tape shift key (for issuing the tape shift instruction) are operated simultaneously or in a predetermined sequence, in short, when the second tape box is instructed, an internal area obtained by removing part of the area A1 of the first print image G1 along the outer periphery thereof by predetermined widths is set to the second print image area A2. In other words, in the image forming method in this example, the second print image area A2 is set to be formed by an internal area obtained by removing part of the area A1 of the first print image G1 along the outer periphery thereof by predetermined widths. More specifically, the second print image area A2 in this case is formed by an area narrower (smaller in size) than the area of the first print image G1 by a predetermined width, and hence by printing the second print image G2 on the second tape T2 different from the first tape T1 in width, background color, background pattern, texture, and the like, and affixing the same on the second print image area A2 (synthesizing the second print image G2 with the first print image G1), it is possible to cause an contour (outline of the second print image G2; contour of the second label affixed to the second print image area A2 when a non-transparent tape T2 is employed) to appear as the enclosing box of the second print image G2. This makes it possible to produce (the first print image G1 for) the (composite) label L2 appearing to be provided with an attractive enclosing box.

Although in the examples described hereinabove with reference to FIGS. 4A to 6D, a document image formed by a single line in a single paragraph is taken as an example of a whole image, this is not limitative, but the tape printing apparatus 1 is capable of dealing with a plurality of paragraphs and a plurality of lines, so that in the following, an example coping with a document image having a plurality of paragraphs and a plurality of lines will be described in detail.

First, in the tape printing apparatus 1, by operating (depressing) the paragraph break insertion key, it is possible to issue a paragraph break insertion instruction for arranging (inserting) a new paragraph in the first print image G1 at a location immediately before a cursor position at the time of depression. Therefore, by operating both the tape shift key and the paragraph break insertion key, it is possible to issue "second tape paragraph" ("replaced-tape paragraph") to assign a designated paragraph to another tape (second tape) to be affixed to the second print image area A2. Also in the case of this function, the paragraph break insertion key and the tape shift key may be operated simultaneously, or the tape shift key may be operated after or before the paragraph break insertion key is operated, without specifically defining the sequence of key operations. More specifically, when the paragraph break insertion key (for issuing a paragraph break insertion instruction) and the tape shift key (for issuing a tape shift instruction) are operated simultaneously or in a predetermined sequence, a new paragraph is set to the second print image area A2, so that by the above key operations, it is possible to shift the apparatus to the second tape edit mode, and set the second print image area A2 (new paragraph). This makes it possible to produce (a first print image for) a (composite) label appearing to be provided with an attractive paragraph-enclosing box.

Figure 7A:
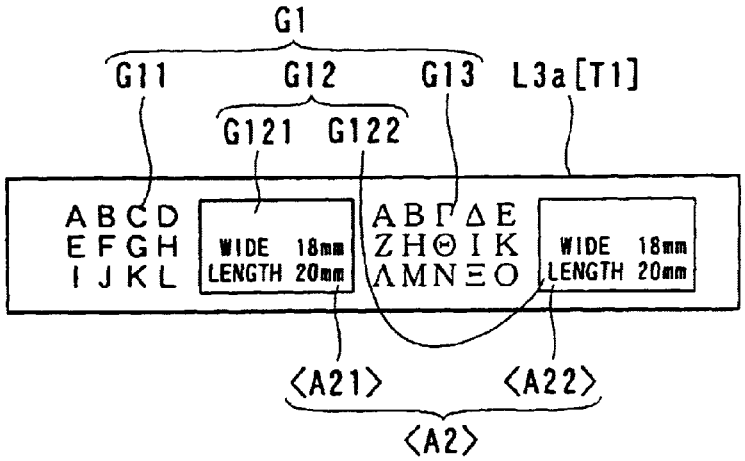
FIGS. 7A to 7D are diagrams similar to FIGS. 4A to 4D, which illustrate still another example.
Figure 7B:
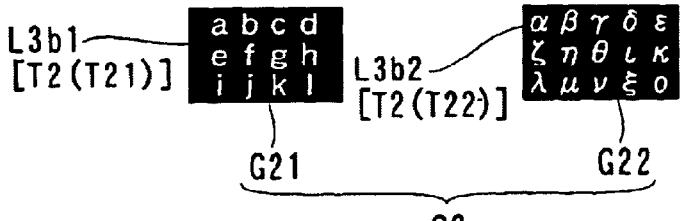
Figure 7C:
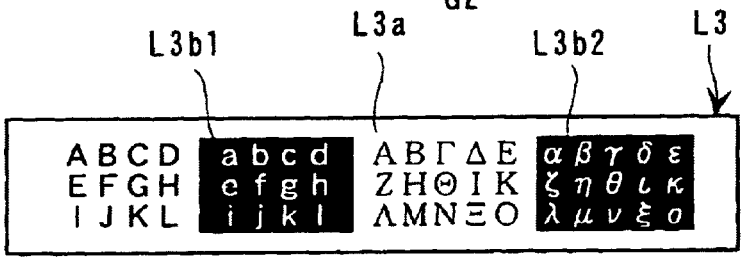
Figure 7D:
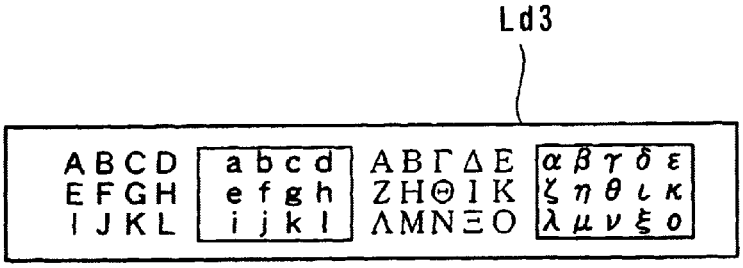

For instance, as shown FIGS. 7A to 7D, a first tape T1 having a first tape width of 24 mm with a white background for use with black characters (tape cartridge C containing a set of a white tape T and a black ink ribbon R) is used as the base of a whole. Further, document images in the second and fourth paragraphs of a whole image comprised of four paragraphs are set to second print image G21, G22, and a second tape T2 which has a second tape width of 18 mm with a black background for white characters (tape cartridge C containing a set of a black tape T and a white ink ribbon R) is employed. In this case, it is possible to produce a composite label L3 as shown in FIG. 7C. More specifically, FIG. 7D shows a label Ld3 produced by enclosing paragraphs in a box by employing the conventional "method of enclosing characters in a box". In comparison with the label Ld3, according to the image forming method and label producing method in the present example, as shown in FIG. 7C, it is possible to produce a (composite) label L3 with a more attractive "paragraph-enclosing box" by deliberately selecting a type of the second label L3*b* (in respect of width, background color, background pattern, texture etc.).

It should be noted that also in the case of the above example, any of the above (1) to (3) Procedures, that is, (1) "Procedure of inserting a second print image (area)", (2) "Procedure of forming a second print image (after providing a second print image area) in the course of forming a first print image", and (3) "Procedure of designating the range of a second print image (area)" can be employed.

For instance, if Procedure (1) is employed, after a state in which an image (first paragraph image) G11 forming a paragraph formed of lines ⌈ABCD⌋, ⌈EFGH⌋ ⌈IJKL⌋ (⌈⌋ represents each line), and an image (third paragraph image) G13 forming a paragraph formed of lines ⌈ABΓΔE⌋, ⌈ZHΘIK⌋, ⌈ΛMNΞO⌋ are provided, a second print image G21 is formed by setting a second print image area A21 between the first paragraph image G11 and the third paragraph image G13 in an inserting manner, and a second print image area A22 is set immediately after the third paragraph image G13 to form a second print image G22.

For instance, when the second tape paragraph (i.e. forming thereof) is instructed by the user in a state in which the character "A" arranged at the head of the third paragraph image G13 is designated with the cursor, a new paragraph is inserted at a location immediately before the character "A" at the head of the third paragraph, that is, at a location between the character "L" at the end of the first paragraph and the character "A" at the head of the third paragraph, and the new paragraph is assigned to the second tape T. Therefore, after that, the user can set the second print image area A21 by designating the tape width and length thereof and inputs lines of ⌈abcd⌋, ⌈efgh⌋, ⌈ijkl⌋ to form (provide) the second print image G21. Similarly, when the second tape paragraph (i.e. the forming thereof) is instructed in a state in which a location immediately after the third paragraph image G13 is pointed by the cursor, a new paragraph is inserted at the location (i.e. at the end of the third paragraph image G13), and the new paragraph is assigned to the second tape T. Then, the user can set the second print image area A22 by designating the tape width and length thereof and inputs lines of ⌈αβγδε⌋, ⌈ζηθικ⌋, ⌈λμνξο ⌋ to form (provide) the second print image G22.

After that (from the state of the first tape T1 being mounted), the first print image G1 (including the contour image G12) is printed on the first tape T1 by depressing the print key, to produce a first label L3*a*(see FIG. 7A). Thereafter, the second tape T2 is mounted (the first tape is replaced by the same), and after the apparatus is shifted to the second tape edit mode by depressing the tape shift key, the print key is depressed, whereby it is possible to print the second print images G2 (G21, G22) on the second tape T2 to produce second labels L3b1, L3b2 (see FIG. 7B). Consequently, the second print images G2 (G21, G22) of the second labels L3b1, L3b2 are affixed to the second print image areas A2 (A21, A22) of the first label L3*a,* whereby it is possible to produce the composite label L3. Although in the above description, it is assumed that a new paragraph is inserted at a location immediately before the cursor position, the apparatus may be configured such that a new paragraph can be inserted backward of a location pointed by the cursor.

Further, for instance, if (2) "Procedure of forming a second print image (after providing a second print image area) in the course of forming a first print image" is employed, after the first paragraph image G11 is formed in the first tape edit mode, the paragraph break insertion instruction is issued to shift the apparatus to the second tape edit mode, and in the second tape edit mode the second print image area A21 is set to a new paragraph area. At the same time, the second print image G21 is formed, and the paragraph break insertion instruction is issued to restore the apparatus to the first tape edit mode (tape shift cancellation). Then, similarly, after the third paragraph image G13 is formed in the first tape edit mode, the paragraph break insertion instruction is issued to shift the apparatus to the second tape edit mode, and in the second tape edit mode the second print image area A22 is set to a new paragraph area. At the same time, the second print image G22 is formed, and the paragraph break insertion instruction is issued to restore the apparatus to the first tape edit mode. After that (in the state of the first tape T1 being mounted), the first print image G1 is printed to produce the first label L3*a*. Then, after tape replacement, the second print images G2 (G21, G22) are printed to produce the second labels L3b1, L3b2. The second print images G2 (G21, G22) of the second labels L3b1, L3b2 are affixed to the second print image areas A2 (A21, A22) of the first label L3*a,* whereby it is possible to produce the composite label L3.

It should be noted that in the above Procedures (1) and (2), the second print images G2 (G21, G22) may be formed after the second print image areas A2 (A21, A22) have been provided by inputting the width and length thereof, or after the second print images G2 have been formed, an area corresponding to each second print image G2 may be provided as the second print image area A2. Further, in the above cases, it is also possible to provide only the second print image area A2 for the time being so as to allow the second print image G2 to be formed after mounting the second tape (after replacing the tapes). Further, to this end, respective separate tape printing apparatuses can be used to produce the first label L3*a*and the second label L3*b* (L3b1, L3b2). Although in this example, (the labels having) the second print images G21, G22 are formed by using the same type of the tape T2, different types of tapes may be used e.g. as second tapes T21, T22, and printed with the second print images G21, G22, to produce the second labels L3b1, L3b2, respectively.

Further, if the whole of a tape can be subjected to negative printing of print images, the tape having a white background for use with black characters, similar to the first tape T1, may be employed as the second tape T2 to be subjected to negative printing. In this case, the tape can be printed with the second print images G21, G22 to produce the second labels L3b1, L3b2. Further, when the negative printing is employed, if a tape having a transparent background for use with black characters (tape cartridge C containing a set of a transparent tape T and a black ink ribbon R) is used as the second tape T2, the transparent background permits the third paragraph image G13 to be seen even if a second label having the second print images G21, G22 printed thereon by continuous negative printing is directly affixed onto the first label L3*a* to cover part thereof including the third paragraph. This makes it possible to produce the second labels L3*b* without cutting them off from each other.

Next, for instance, if (3) "Procedure of designating the range of a second print image (area)" is employed, first, in the first tape edit mode, the user inputs all the four paragraphs, i.e. the first paragraph formed of lines ⌈ABCD⌋, ⌈EFGH⌋ ⌈IJKL⌋, the second paragraph formed of lines ⌈abcd⌋, ⌈efgh⌋, ⌈ijkl⌋, the third paragraph formed of lines ⌈ABΓΔE⌋, ⌈ZHΘIK⌋, ⌈ΛMNΞo⌋, and the fourth paragraph formed of lines ⌈αβγδε⌋, ⌈ζηθικ⌋, ⌈λμνξο ⌋, and forms all the paragraph images in advance. Then, if the user depresses the tape shift key after designating the ranges of the second and fourth paragraphs, he can produce the same first label L3*a,* second label L3*b,* and composite label L3 as the labels produced by the above procedures (1) and (2).

As described hereinbefore, according to the image forming method in the above example, the first print image G1 is set to include a plurality of paragraphs (four in the above example), and the second print image area A2 (A21, A22) is set to bear at least one (two in the above example) of the plurality of (four) paragraphs when the second print image G2 (G21, G22) is affixed to the area. Hence, if the first print image G1 is printed on the first tape T1, and the second print image G2 (G21, G22) is printed on the second tape T2 different from the first tape T1 in width, background color, background pattern, texture, and the like, to affix the same onto the second print image area A2 (A21, A22) (synthesize the second print image G2 with the first print image G1), it is possible to assign at least one (two in the above example) paragraph to the second print image G2. This makes it possible to produce the first print image G1 for the composite label L3 appearing to be provided with an attractive paragraph-enclosing box.

Although in the tape printing apparatus 1, as described above with reference to FIGS. 4A to 4D, the user can display the whole print image (synthetic image formed by synthesizing the second print image G2 (G21, G22) with the first print image G1 in the second print image area A2 of the first print image G1) including the second print image G2 as well on the display screen 41 of the display 4, and edit the whole print image (synthetic image), this is not limitative, but the tape printing apparatus 1 is configured such that when the whole print image is displayed, it can further display the second print image area A2 (and the second print image G2 in the area A2) in a manner distinguishing the same from other areas. More specifically, the tape printing apparatus 1 is configured such that it can display the second print image G2 in the second print image area A2 in reverse video (reverse display function) by switching the display mode (therefore, an image obtained by the reverse video function is identical to the image shown in FIG. 7C). Now, the reason for enabling the apparatus to switch between the display modes (normal mode and revere video function mode) is that when the print images are printed as shown in FIG. 4C, more specifically, when the first print image G1 having the second print image area G2 specifically indicated is formed and printed, it is possible to display the second print image area A2 (and the second print image area G2 in the area A2) in a distinct manner from other areas, simply by displaying the first print image G1 as it is, without turning to the above reverse display function. In the tape printing apparatus 1, the second print image area A2 can be displayed in a manner distinguishable from other areas by making use of either of the normal display function and the reverse display function, so that the areas can be viewed or checked before the first print image G1 is printed.

Further, the tape printing apparatus 1 is configured such that it is capable of not only designating the range of the second print image (area) by drag operation, described above, using the cursor, or by designating the start point and end point of the second print image (area), described above, but also designating a desired area, by making use of a view of the whole (synthetic) image displayed on the above display screen 41. This is for making the apparatus convenient for employing the above-mentioned (3) "Procedure of designating the range of a second print image (area)". More specifically, in the tape printing apparatus 1, it is possible to employ various area-designating methods, such as a rectangular area-designating method of designating a start point and an end point to designate a region having a rectangular shape with a straight line connecting the start point and the end points as a diagonal line thereof, a polygonal area-designating method of designating an area by sequentially specifying respective corners of a polygonal area, and an arbitrarily-shaped area-designating method of designating an area desired to be specified by cumulatively designating dots in the area (e.g. by displaying dots with a specified resolution in reverse video, thereby designating an area indicated by black dots as a specified area). In the tape printing apparatus 1, when the mode is switched to the area-designating mode by the user, menu options for selecting the above area-designating methods are displayed, so that the user can select any one from the methods for use. It is assumed here that each of the above points (dots) is designated by operating (depressing) the shift key after the cursor is moved onto the point (dot) desired to be designated. Of course, any other method may be employed so long as the same effect can be obtained. As described above, in the tape printing apparatus 1, it is possible to easily designate the second print image area A2 on the display screen 41 by using various area-designating means.

Now, according to the tape printing apparatus 1, by operating (depressing) the new line start key, it is possible to issue a new line start instruction for starting a new line (arranging a new line) at a location immediately before a cursor position whenever the user desires to start a new line. Therefore, by operating both the tape shift key and the new line start key, it is possible to instruct a "second tape line" ("replaced-tape line") for assigning a designated line to another tape (second tape) to be affixed to the second print image area A2. Also in the case of this function, the new line start key and the tape shift key may be operated at the same time, or the tape shift key may be operated after or before the new line start key is operated, without defining the sequence of key operations. More specifically, when the new line start key (for issuing a new line start instruction) and the tape shift key (for issuing a tape shift instruction) are operated simultaneously or in a predetermined sequence, a new line is set to the second print image area A2, so that through these key operations, it is possible to shift the apparatus to the second tape edit mode, and set the second print image area A2 (new line). This makes it possible to produce (a first print image for) a (composite) label appearing to be provided with an attractive line-enclosing box.

Figure 8A:
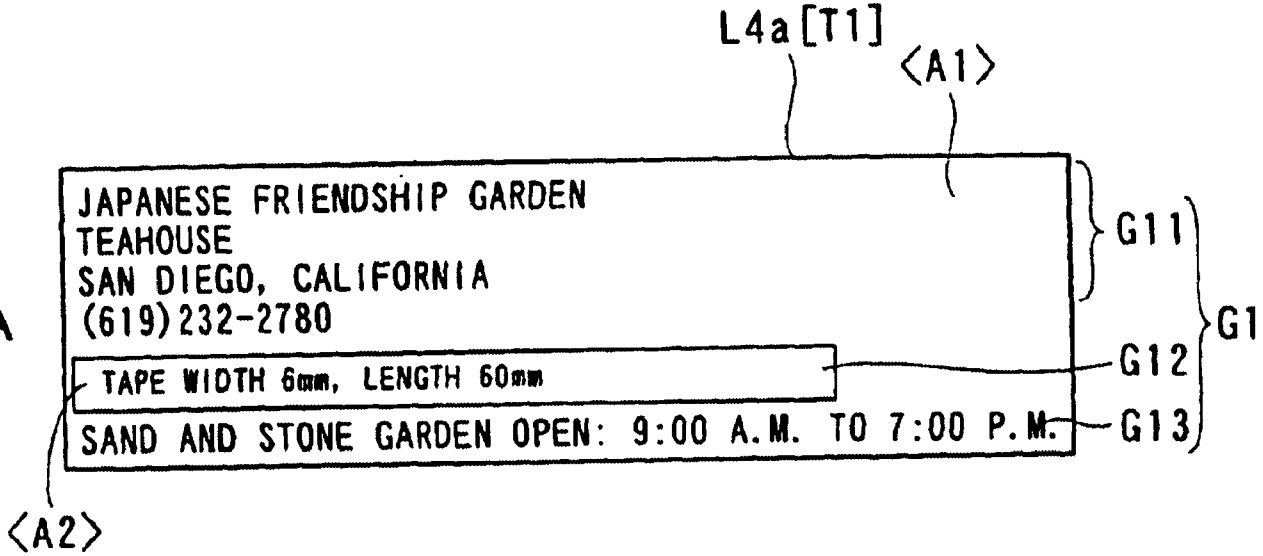
FIGS. 8A to 8D are diagrams similar to FIGS. 4A to 4D, which illustrate still another example.
Figure 8B:
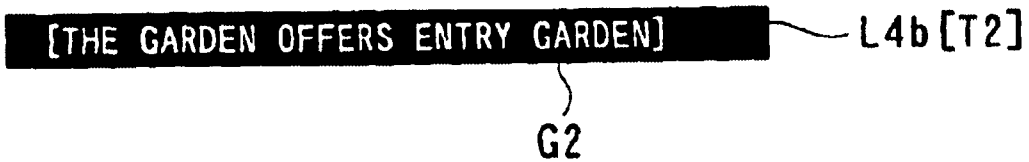
Figure 8C:
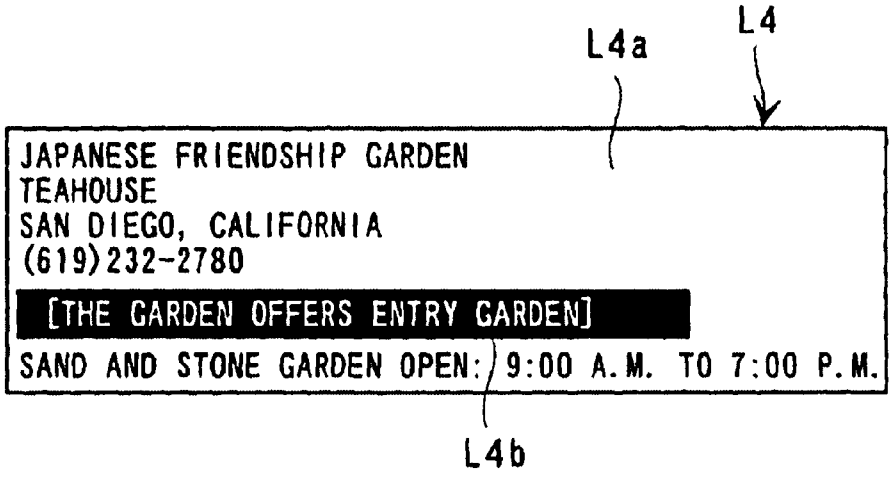
Figure 8D:
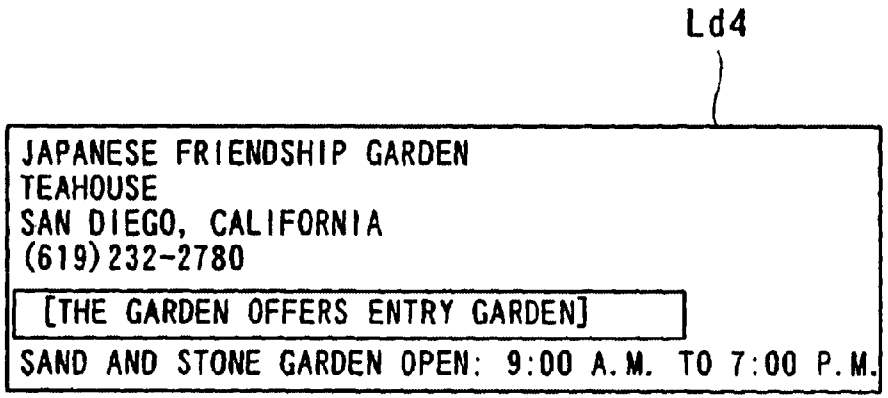

For instance, as shown FIGS. 8A to 8D, when a first tape T1 having a first tape width of 36 mm with a white background for use with black characters is used as the base of a whole, and a document (literal string) image of the fifth line of a whole image of six lines is set to a second print image G2, and when a second tape T2 which has a second tape width of 6 mm with a black background for use with white characters is employed, it is possible to produce a composite label L4 as shown in FIG. 8C. More specifically, FIG. 8D shows a label Ld4 produced by enclosing lines in a box by employing the conventional "method of enclosing characters in a box". In comparison with the label Ld4, according to the image forming method and label producing method in the present example, as shown in FIG. 8C, it is possible to produce a (composite) label L4 with a more attractive "line-enclosing box" by deliberately selecting a type of the second label L4*b* (in respect of width, background color, background pattern, texture, etc.).

It should be noted that also in the case of the above example, any of the above Procedures (1) to (3), that is, (1) "Procedure of inserting a second print image (area)", (2) "Procedure of forming a second print image (after providing a second print image area) in the course of forming a first print image", and (3) "Procedure of designating the range of a second print image (area)" can be employed. However, this capability is substantially the same as the capability described above with reference to FIGS. 4A to 7D, and can be known by analogy, so that detailed description thereof is omitted. By any of the procedures, the first print image G1 is formed, and the second print image area A2 is set, followed by the second print image G2 being formed. Then, in the state of the first tape T1 being mounted, the first print image G1 (including the contour image G12) is printed on the first tape T1 by depressing the print key, to produce a first label L4*a* (see FIG. 8A). Thereafter, the second tape T2 is mounted (the first tape is replaced), and after the apparatus is shifted to the second tape edit mode by depressing the tape shift key, the print key is depressed, whereby it is possible to print the second print image G2 on the second tape T2 to produce a second label L4*b* (see FIG. 8B). The second print image G2 of the second label L4*b* is affixed to the second print image area A2 of the first label L4*a,* whereby it is possible to produce the composite label L4.

Further, in this example as well, in the above Procedures (1) and (2), the second print image G2 may be formed after the second print image area A2 has been provided by inputting the width and length thereof, or after the second print image G2 has been formed, an area corresponding to the second print image G2 may be provided as the second print image area A2. Further, it is also possible to provide or secure only the second print image area A2 for the time being to allow the second print image G2 to be formed after mounting the second tape (after replacing the tapes). Further, to this end, respective separate tape printing apparatuses can be used to produce the first label L3*a* and the second label L3*b* (L3b1, L3b2). Further, if the whole of the tape can be subjected to negative printing, the tape having a white background for use with black characters, similar to the first tape T1, may be employed as the second tape T2 to be subjected to negative printing. Thus, the tape can be printed with the second print image G2 to produce the second label L4*b.* Further, a tape having a transparent background for use with black characters can be used as the second tape T2.

As described hereinbefore, according to the image forming method in the above example, the first print image G1 is set to include a plurality of lines (six lines in the above example), and the second print image area A2 is set to bear at least one (fifth line in the above example) of the plurality of (six) lines when the second print image G2 is affixed to the area. Hence, by printing the first print image G1 on the first tape T1, and the second print image G2 on the second tape T2 different from the first tape T1 in width, background color, background pattern, texture, and the like, to affix the same onto the second print image area A2 (synthesize the second print image G2 with the first print image G1), it is possible to assign at least one line to the second print image G2. This makes it possible to produce the first print image G1 for the composite label L4 appearing to be provided with an attractive line-enclosing box.

Although in the above examples described above with reference to FIGS. 4A to 8D, a composite label is formed by, so to speak, a double label having a first label and a second label affixed to the first label, it is possible to produce a more diversified and attractive composite label by preparing the label as a multi-level composite label. In the following, the method of forming multi-level composite label will be described.

For instance, an example shown in FIGS. 9A to 9D is, so to speak, an application of the FIGS. 8A–8D example described above, and literal strings thereof are identical to those in the above example. In the 9A–9D example, first, a first tape T1 having a first tape width of 48 mm with a white background for use with black characters is used as the base of a whole. Further, first and second lines, and fifth and sixth lines are assigned to the second print image G2 (G21, G22). Respective separate tapes T are used as second tapes T2 (T21, T22), and the second print image G21 having the first and second lines assigned thereto is printed on the second tape 21 which has a second tape width of 12 mm and a green background for use with red characters, to produce a second label L5b1, while the second tape 22 which has a second tape width of 18 mm with a black background for use with white characters is used to produce a second label L5b2 having the second print image G22 of the fifth and sixth lines assigned thereto. Although the example in FIGS. 9A to 9D is distinguished from the example in FIGS. 8A to 8D in that a plurality of portions thereof are assigned to the second print image G2, and printed on different second tapes respectively, this holds true with the example described above with reference to FIGS. 7A to 7D, and can be known by analogy, so that detailed description thereof is omitted. In this example, however, the label (second label) having the second print image G22 assigned thereto as part of the second print image G2 is formed as a composite label.

More specifically, in the second print image G22 of the second label L5b2 having two lines (fifth and sixth lines) assigned thereto, a lower line is set to bear a third print image G3, and a tape T3 having a third tape width of 6 mm with a white background for use with black characters is employed to produce a third label L5b2*b*printed with the third print image G3, while a second print image G221, which has a third print image area A3 provided therein to which the third print image G3 is to be affixed (and includes a contour image G222 of the third print image area A3), is printed on the second tape T22 to produce a second label L5b2*a*. Then, the third print image G3 of the third label L5b2*b* is affixed onto the third print image area A3 of the second label L5b2*a* (synthesized with the second print image G23), whereby a second (composite) label L5b2 can be produced as the composite label. The second label L5b2 and the second label L5b1 produced as a label (second label) at the same hierarchical level as the label L5b2 are affixed to the second print image area A2 (A21, A22) of the first label L5*a,* to produce a composite label L5.

Also in the case of the above example, any of the above Procedures (1) to (3) can be employed. Further, as described above, in the Procedures (1) and (2), it is also possible to provide or secure only the second print image area A2 (A21, A22) for the time being, print the first print image G1 which has the second print image area A2 (A21, A22) provided therein (and includes the contour image of the second print image area A2, on the first tape T1, and produce the second print image G2 after mounting the second tape (replacing the tapes). Therefore, in the following, the above procedure for producing the second print image G2 is employed as the most understandable procedure, and detailed description thereof will be given based thereon.

Figure 9A:
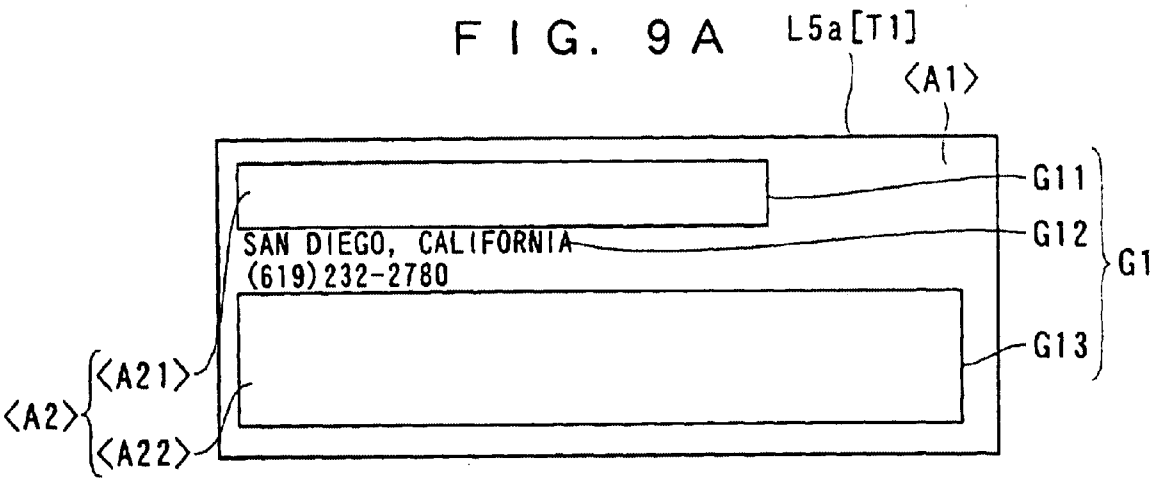
FIGS. 9A to 9D are diagrams similar to FIGS. 4A to 4D, which illustrate still another example.
Figure 9B:
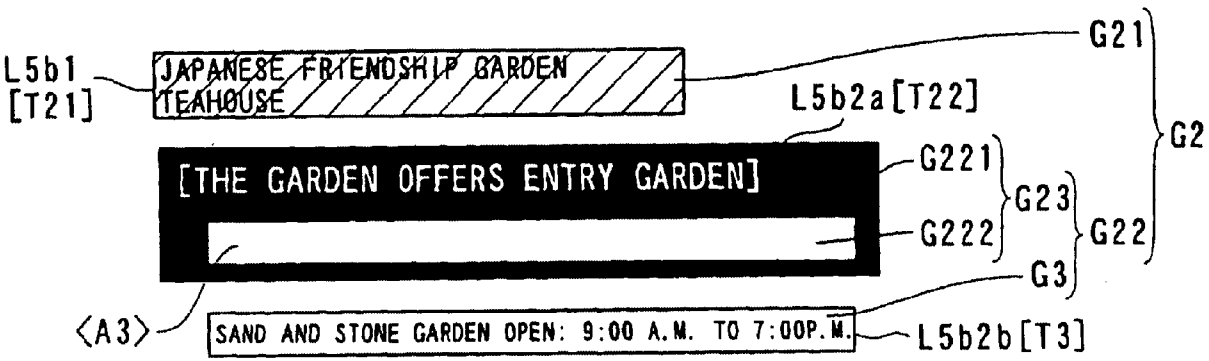
Figure 9C:
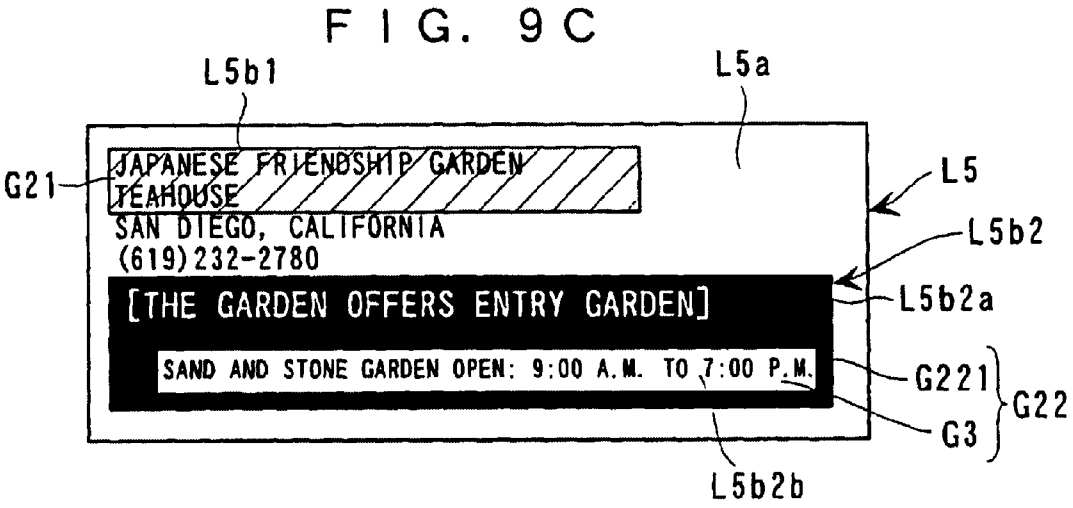
Figure 9D:
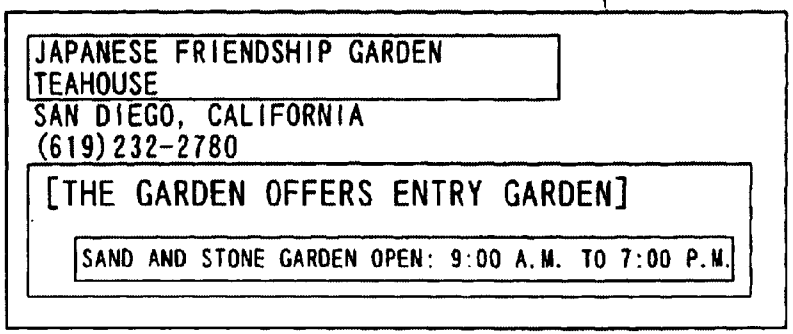
Figure 10B:
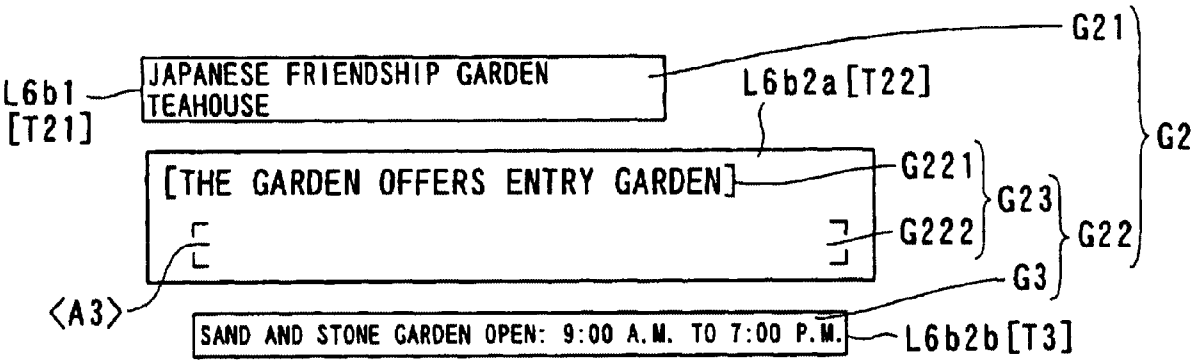
FIGS. 10A to 10D are diagrams similar to FIGS. 4A to 4D, which illustrate still another example.
Figure 10A:
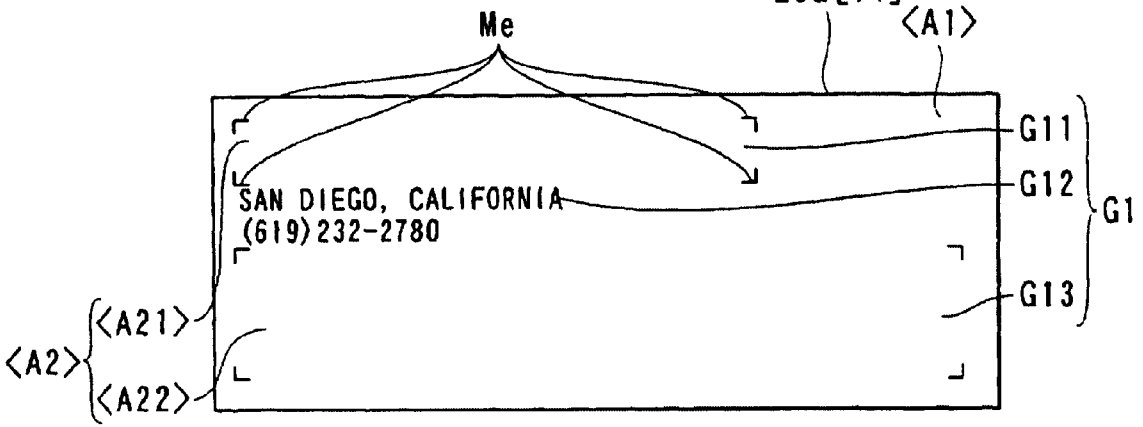
Figure 10C:
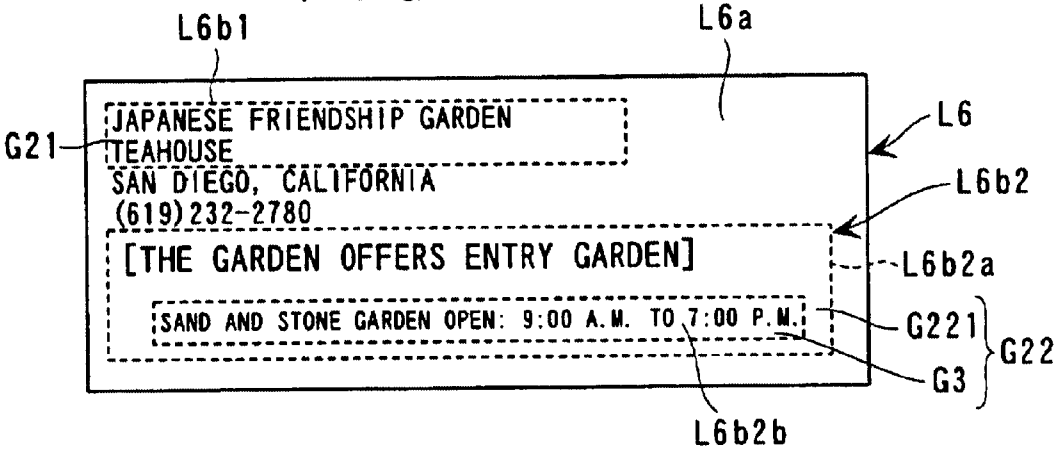
Figure 10D:
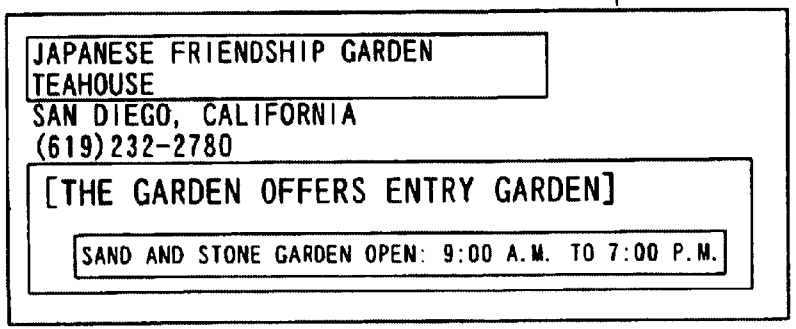

First, according to the Procedure (1) or (2), without producing the second print image G2 (G21, G22), the first print image G1 having the second print image area A2 (A21, A22) provided therein (and including the contour images G11, G13) is printed on the first tape T1 to produce the first label L5*a* (see FIG. 9A). Next, as shown in FIG. 9B, the second tape T21 is mounted (the first tape is replaced thereby), and then the print image G21 is formed and printed on the second tape T21 to produce the second label L5b1. Next, the second tape T22 is mounted (the first tape is replaced thereby), and similarly to the first label L5*a,* only the third print image area A3 is provided as an affixing area for having the third print image G3 affixed thereto which is a print image at a hierarchical level positioned under the second print image. Then, the second print image G22 having the third print image area A3 provided therein (and including the contour image G222) is formed and printed on the second tape T22 to thereby produce the second label L5b2*a*. Next, the third tape T3 is mounted (the second tape is replaced thereby), and the third print image G3 is formed and printed on the third tape T3 to thereby produce the third label L5b2*b*. At this time point, all the labels (first label L5*a,* second label L5b1, second label L5b2*a,* third label L5b2*b*) to be provided are produced, and as shown in FIG. 9C, they are sequentially affixed to the predetermined affixing areas provided in advance, whereby the composite label L5 having all the labels synthesized thereon can be produced.

It should be noted that by properly employing another procedure as the situation requires, the composite label L5 can be produced similarly to the above. For instance, the above third print image G3 can be formed together with the second print image G22. In this case as well, the third print image G3 may be formed after the third print image area A3 has been provided (set), or after the third print image area A3 has been formed, the third print image area A3 may be provided (set) in a manner adapted thereto. Or further, after the second print image G22 has been formed such that it includes the third print image G3, the range of a portion to which the third print image G3 is to be affixed may be designated to secure (set) the third print image area A3. Furthermore, the composite label L5 may be produced in a manner such that after the whole image corresponding to the FIG. 9C label is formed first, the range of a portion to which the second print image G21 of the whole image is to be affixed is designated to secure the second print image area A21, while similarly, the range of a portion to which the second print image G22 is to be affixed is designated to secure the second print image area A22 and then, instead of printing the second print image G22, the range of a portion to which the third print image G3 is to be affixed is designated to secure (set) the third print image area A3.

As described hereinbefore, according to the image forming method (and label producing method) in the above example, it is possible to advance the method of forming the double composite label in which a second label is affixed onto a first label, to a method of forming a multiple composite label (triple, in the above example). This makes it possible to produce a further diversified and attractive composite label.

In each example described above, the tape shift cancellation instruction is issued through the same operation (depression of the tape shift key) as carried out for issuing the tape shift instruction, and whenever the same operation is carried out, the apparatus is shifted between the first tape edit mode and the second tape edit mode. However, in the example described above with reference to FIGS. 9A to 9D, it is possible also to produce a composite label with the simultaneous use of three or more (hierarchical levels of) tapes (labels) in mind. More specifically, in this case, to produce a triple composite label in the same manner as described above, by providing the third print image area to which is to be affixed the third print image of the third label formed by still another tape (third tape) in the area of the second print image of the second label, the apparatus may be configured to be provided with a tape shift cancellation key (for issuing the tape shift cancellation instruction) as a separate member from the tape shift key (for issuing the tape shift instruction). In this case, whenever the tape shift instruction is issued, the tape edit mode is shifted in a manner such that the first tape edit mode→the second tape edit mode→a third tape edit mode→. . . (a tape edit mode at a even lower hierarchical level), whereas whenever the tape shift cancellation instruction is issued, the tape edit mode is shifted inversely in a manner such that (the tape edit mode at a lower hierarchical level) . . . →the third tape edit mode→the second tape edit mode→the first tape edit mode. Thus, it is possible to produce print images including print images at lower hierarchical levels, such as a third print image and the like, first (i.e. before execution of printing operation) to check on a whole image (as a result of synthesis) on the display screen or the like, and then, while replacing tapes, to sequentially print images at respective hierarchical levels, thereby producing labels at the respective hierarchical levels.

Now, as described above with reference to FIGS. 4A to 9D, it is possible to affix the second print image onto the second print image area as an affixing area for having the second print image of the second label to be affixed thereto, which is provided in a area of the first print image of the first label used as the base of a whole, thereby synthesizing the first print image and the second print image into an image to produce a composite label bearing the synthesized image. This means that so long as a composite label to be produced has a whole image with only one portion thereof different from the base image, it is possible to produce the composite label simply by affixing a new print image onto the different portion. Further, it is possible to produce a label by replacing a tape after a print image is affixed thereto (synthesized therewith) or by affixing a print image onto a label already having another print image affixed thereto (synthesized therewith). Additionally, if a plurality of types of labels having second print images affixed thereto are provided in advance with variations within a predictable range, it is possible to select any of the plurality of types of labels at a desired time point to produce a composite label having the second image of the selected label affixed thereto.

For instance, in the case of the examples illustrated in FIGS. 4A to 6D, and FIGS. 8A to 8D, if there are provided in advance a wide variety of second print images G2 and various types of second tapes T2 as print media, composite labels having different details and designs from each other can be produced with ease. Further, in the examples illustrated in FIGS. 7A to 7D, and FIGS. 9A to 9D, there can be provided in advance a wide variety of the respective second print images G21 and G22 and various types of second tapes T2 as print media, thereby making it possible to produce more diversified composite labels (different from each other) with ease.

For instance, in FIGS. 9A to 9D, the composite label L5 has so-called "announcement" printed thereon. The second print image G21 indicates, so to speak, an issuing source (department). When there is a possibility that another department exists in the same address (e.g. annex adjacent to the teahouse) to issue a similar announcement therefrom, if only the (second label L5b1 printed with the) second print image 21 is replaced (e.g. by a label printed with a literal string "TEAHOUSE ANNEX"), it is possible to easily produce a composite label having a different issuing source printed thereon without changing the other portions. Similarly, the second print image G22 can be printed with, so to speak, information of service or the like. When it is required to provide another piece of information of service, it is possible to easily produce a composite label for the announcement at any time.

Although in the examples illustrated in FIGS. 4A to 9D, attention is paid to the fact that labels responsible for respective print images are different from each other, and a plurality of type of tapes different from each other in width, background color, background pattern, texture, and the like are employed, and selectively designated such that a different portion is made conspicuous (to appear e.g. as an enclosing box or frame), in the application as described above, there is sometimes a case in which no change in only a portion of a whole image is desired to be specifically shown. In such a case, as shown in FIGS. 10A to 10D in a manner corresponding to FIGS. 9A to 9D, a tape having a transparent background for use with black characters is selected as the second tape T2 or the third tape T3, whereby it is possible to produce a composite label L6 which has inconspicuous boundaries for dividing labels (first label L6*a*, second label L6b1, second label L6b2*a*, third label L6b2*b*) (the boundaries are shown in FIGS. 10A to 10D for convenience of explanation of figures referred to hereinafter).

Although in the tape printing apparatus 1 according to the above embodiment, it is assumed that options of tape widths equal to or smaller than the tape width (first tape width) of the first tape T1 whose type has been detected are displayed on the display screen 41 of the display 4 as candidates for the tape width (second tape width) of the second tape T2 when the tape shift key is depressed, and that the user can select and designate any of the tape widths, the apparatus may be configured such that a type of second tape T2 can be selected from options including not only the second tape width but also the background color, background pattern, and material (texture) of the second tape T2, on condition that the second tape width is equal to or smaller than the first tape width. Further, in this case, not only tapes T supplied in a state accommodated in the tape cartridge C but also tape strips (short strips) having a predetermined length and mountable in the apparatus may be contained in the selectable types of second tape T.

In the above cases, since the type of the second tape T2 can be designated from the plurality of types thereof, it is possible to produce the first print image G1 by taking the types of tape T2, i.e. the width, background color, background pattern, and texture of the tape T2 into account. Further, if the type of the second tape T2 selected corresponds to the second tape width, the second tape width and the width of the second print image G2 can be set based on the type of the second tape T, or alternatively if the second tape T2 selected is of a type with a predetermined tape length, it is also possible to set the length of the second print image G2, thereby simplifying the settings of the second print image area.

Further, when the type of the second tape can be selected by the tape shift instruction (in the second tape edit mode), it is preferred that the apparatus includes means for determining (or the method therefor includes a step of determining) the outline of the second print image area. In this case, since the outline of the second print image area is determined, it is possible to set the second print image area having the outline in the area of the first print image.

Now, when a composite label is produced by affixing the second tape (second label) printed with the second print image onto the first print image printed on the first tape (first label), if the second tape has a transparent background, the second print image printed on the second tape appears to be directly formed on (the area of) the first print image, and even if the outer periphery of the second tape (portion of the tape material of the second tape T2: transparent portion) overlaps the first print image, the first print image under the second tape can be seen through. More specifically, if the type of the second tape can be selected when the first tape is replaced, and if the second tape selected (designated) is of a type having a transparent background, the first label under the second tape can be seen through the transparent tape material of the second tape when it is affixed to the first tape. Therefore, an area to be provided as the second print image area is only required to be inside the outline of the second print image itself printed on the first label. In the above case, it is preferred that a line outlining the outer periphery of the non-transparent portion of the second print image is determined as the outline of the second print image area. Thus, (the outline of) the second print image area to be taken into account when the second tape is affixed for synthesis can be set to the area of the non-transparent portion of the second print image, thereby making it possible to produce a label in which the area within the first print image is effectively made use of.

On the other hand, if a tape having a non-transparent background is designated as a second tape, it is only required that a line indicating the outline of an area to which is to be affixed the second tape (second label) having the second print image printed thereon is determined as the outline of the second print image area. This makes it possible to set the second print image area within the area of the first print image such that the non-transparent second tape can be affixed properly with ease.

Further, although in the example illustrated in FIGS. 10A to 10D, for instance, the second tapes T21, T22 having the second tape widths of 12 mm, 18 mm with transparent backgrounds, respectively, are used in a manner adapted to the example illustrated in FIGS. 9A to 9D, ranges substantially occupied by the second print images are portions of colored (black) characters in the case of the transparent tapes being used, so that second tapes T21, T22 having slightly larger widths (e.g. of 18 mm, 24 mm, respectively) than the above second tapes T21, T22 may be employed assuming that characters of the same size are used (printed). Further, for instance, in the second label L6b1, an actual colored portion is the portion of characters, and if the second print image area is outlined along an outer periphery thereof (i.e. a line connecting the outer ends of the outlines of respective characters), the result is a complicated contour, whereas when the second print image area of the example illustrated is set, if the area is set as a rectangular area containing the contour, it is possible to use the area substantially fully effectively.

To realize this, e.g. in the example illustrated in FIGS. 10A to 10D, it is only required that a line indicative of the contour of an area (rectangular area) to which is to be affixed the second label L6b1 printed with the second print image G21 (literal string image of two lines) is set to the outline of the second print image area A21. However, also when the second tape which has a transparent background but has a large tape width is employed as described above, it is preferred that the line indicative of the contour of the second label-affixing area is set to the outline of the same second print image area A21. In this case, the second print image area A21 becomes a rectangular area which is slightly smaller (narrower) than the area (rectangular area) for having the second label L6b1 thereto, and at the same time contains the outer periphery of the colored portion (outline of the second print image area). More specifically, when the second tape is transparent, the outline of the second print image area A21 is a line outlining the outer periphery of the colored portion, whereas when the second tape is non-transparent, the outline of the second print image area A21 is a line indicating the contour of the second label. However, if the second print image area A21 is formed to be a rectangular area containing the outline of the second print image area A21, the second print image area A21 in the case of the second tape being transparent and the second print image area A21 in the case of the second tape being non-transparent can be similarly dealt with as the rectangular area. The example illustrated in FIGS. 10A to 10D is exactly an example in which the second print image area A21 is dealt with as rectangular area, which enables the second labels to be produced similarly to the example illustrated in FIGS. 9A to 9D. Although in the above example, description is given of the second print image area A21 (second label L6b1), this holds true with the second print image area A22 (second label L6b2).

In the examples illustrated in FIGS. 4A to 10D, the second print image areas are all dealt with in the same manner as rectangular areas including the outlines thereof, and hence it is possible to form second print images to produce labels in the same manner in the above examples. More specifically, in each of the above examples, the second print image area is formed to be a rectangular area including the outline thereof, so that the second print image area can be set basically by determining the length and width thereof. For instance, assuming that the width of the second print image area is known in advance based on the type of a tape in use, or that the width is already set or determined, by inputting the length of the area, it is possible to complete the setting of the second print image area. Further, e.g. when a whole image is formed by a document image of a plurality of paragraphs, if the whole of a predetermined one of the paragraphs is used as a second print image, the predetermined paragraph is defined to have a predetermined width equal to or slightly smaller than that of the whole image. Therefore, by inputting the length of the paragraph in a state in which a reference point of the paragraph in the direction of the length thereof is set, it is possible to complete the setting of the second print image area.

On the other hand, assuming that the length of the second print image area is known in advance based on the type of a tape in use, or that it is already set, by inputting the width of the area, it is possible to complete the setting of the second print image area. For instance, when a single paragraph or an image for being subjected to fixed length printing is used as a whole image, if the whole of a predetermined line of a plurality of lines, which should have a length within a predetermined length (fixed length), is used as a second print image, the predetermined line can be determined to have a predetermined length equal to or slightly shorter than that of the whole image. Therefore, by inputting the width of the line in a state in which a reference point of the line in the direction of the width thereof is set, it is possible to complete the setting of the second print image area. Further, the apparatus may be configured such that a second tape width can be input. In this case, since the second tape width can be entered, it is possible to set the width of the second print image based on the entered second tape width, by defining the relationship between the second tape width and the width of the second print image in advance.

Further, although in the examples described above with reference to FIGS. 4A to 4D and the like, it is assumed that after the second tape width has been selected (designated), the tape printing apparatus 1 displays a screen to prompt the user to enter the tape length, thereby enabling him to set the tape length by inputting a numerical value thereof, this is not limitative, but the second print image area A2 may be set after the second print image G2 has been produced, such that the lengths of the leading margin and trailing margin of the second print image G2 can be set by inputting numerical values thereof. Further, the width of the second print image area A2 may be set by inputting a numerical value, not by selecting and designating the same from options therefor. Further, although the length, width, or vertical and lateral margins of the second print image area A2 may be designated by inputting numerical values thereof, they may be designated not only by inputting the numerical values directly from the beginning but also by displaying default values, such as reference values or immediately preceding values, first, thereby allowing the user to increase or decrease the values.

Further, although in the above examples, in determining (setting) the width and length of the second print image area A2 by any of the above-mentioned methods, they are set by operating the tape shift key (for issuing the tape shift instruction) immediately after switching the apparatus from the first tape edit mode to the second tape edit mode, this is not limitative, but they may be set in the timing of restoring the apparatus to the first tape edit mode (for canceling tape shift) by operating the tape shift key.

Further, since a character size can be determined based on the number of lines or the number of characters on a line when the width and length of the second print image area A2 are determined, in the examples illustrated in FIG. 6A et seq., similarly to the example described above with reference to FIGS. 5A to 5D, it is also possible to adjust the character size of the first print image based on the determined character size of the second print image. Further, if characters cannot be accommodated within the determined width and length of the second print image area (for instance, if the number of lines or the number of characters input in minimum character size cannot be accommodated), an error message (such as "Over Line Number", "Over Character Number" or the like) may be displayed to notify the user that the characters cannot be accommodated, giving a higher priority to the determined width and length of the set second print image area, so to speak, similarly to the case of the fixed length printing, or the width and length of the second print image area may be adjusted giving a higher priority to the number of lines and the number of characters. Further, in the case of the latter, if the adjusted width and length of the second print image area are employed, similarly to the above case of characters not being accommodated, it is possible to display an error message to notify the user of the fact that characters cannot be accommodated within the range of the first tape or a range set for (the first print image of) the first label in the fixed length printing.

Further, when a composite label is produced, if the second print image area is provided according to the settings thereof, the user can affix (synthesize) a second print label onto the second print image area such that the label is adjusted to the area, and it is convenient, though not indispensable, to specifically indicate the second print image area in the first print image area of the first label printed. Therefore, it is preferred to provide the first label with an area-indicating function for specifically showing the second print image area after printing the first label. This makes it possible to explicitly show the second print image area on the first label by using the area-indicating function, thereby enabling the (second label printed with the) second print image to be affixed to the second print image area easily. That is, a composite label formed by synthesizing the second print image with the first print image can be produced easily.

In the examples illustrated in FIGS. 4A to 9D, the second print image area is formed as a rectangular affixing area, and the first print image is provided with the contour image G12 in which the contour of the rectangular area is shown by solid lines, whereby the area-indicating function is added to the first print image. By printing the contour image G12 with other parts, the second print image area is specifically indicated after printing the first print image. Now, there are contemplated various methods of adding the area-indicating function to the first print image, and therefore, the description will be given concerning the methods.

First, there is a method of arranging the outline of a second print image area, such as the above outline of the rectangular shape, in the area of the first print image. It should be noted that this method of specifically indicating a second print image area by using an outline thereof can be applied not only to an area having a predetermined shape but also to an area having a desired shape including a polygon as well as a curved line. Further, the outline may be indicated not only by solid lines but also by dotted lines, one-dot chain lines, two-dot chain lines, and the like (see FIG. 10C). Further, the outline of an area slightly smaller in size than a second print image area determined, more specifically, an outline formed by imaginarily deviating the outline of the determined second print image area inward (of the area) by a predetermined width may be indicated by dotted lines or solid lines. In this case, since the area slightly smaller in size than the second print image area has a width determined in advance (predetermined width), similarly to the former case (where the outline of the actual second print image area is arranged), it is possible to specifically indicate the second print image area as well as to hide the first print image under the second print image (or the non-transparent tape material of a second label).

Further, there is another method which can be employed independently of the above method of using the outline of the second print image area (and which can be applied together with the method when the second print image area has a polygonal shape). According to this method, when the second print image area is set as a polygonal area, it is possible to specifically indicate the second print image area by arranging corner marks which indicate the positions of the respective corners of the polygonal second print image area, within the area of the first print image. For instance, if the second print image area is the second print image area S21 appearing in FIG. 10A, having a rectangular shape, it is possible to specifically indicate the second print image area A21 by arranging four corner marks Me. It should be noted that the corner marks Me in the case of this method can be also arranged in a manner deviated from the corners of a determined second print image area in one or respective predetermined direction(s). If the direction(s) of deviation and the distance of the deviation(s) are determined in advance, the second print image area can be specifically indicated similarly to the method of arranging the corner marks Me on the corners of the second print image area. Further, for instance, if the corner marks Me are arranged in a manner deviated outward of the area, when the (second label printed with the) second print image is affixed, the second print image is easily affixed to the second print image area in agreement with the inside of each corner mark, whereas if the corner marks Me are arranged in a manner deviated inward of the area, it is possible to hide the corner marks under the second print image (or the non-transparent tape material of a second label). Thus, variations are possible when a label is affixed (i.e. when a composite label is produced by synthesizing images).

Further, there is still another method which can be applied independently of or together with the method of using the outline of the second print image area and the method of using corner marks. According to this method, a color different from colors arranged in other areas (in the first print image) is arranged in the second print image area, whereby it is possible to make use the difference between colors to specifically indicate boundaries dividing the areas. This method as well can be applied to an area having an arbitrary shape. Further, this method can be also applied to an area slightly smaller in size (by a predetermined area) than a second print image area determined, and also when a color is arranged in a part of the second print image area, smaller than the whole second print image area by the predetermined extent, similarly to the former case of the whole of the second print image area being colored, it is possible to specifically indicate the second print image area since the area is smaller in size by a (predetermined) extent determined in advance. This makes it possible to hide the colored portion under the (the second label printed with the) second print image, similarly to the method of using corner marks and the method of using the outline of the second print image area.

It should be noted that still another method of specifically showing a second print image area may be employed in which a second print image itself is arranged in the second print image area of the first print image on the first tape, for printing. In this case, a second print image printed on a second tape (second label) is affixed to the second print image printed on the first tape (first label) in an overlapping manner, thereby producing a composite label. Further, the second print image itself of a composite label once completed (in other words, a composite label having the second print image of a second label already affixed thereto) can become a new second print image area. More specifically, as described hereinabove with reference to FIGS. 9A to 9B, to produce various composite labels with only a second print image portion being different from the other print image portions, it is possible to employ a method which uses a composite label already produced to replace a second print image portion with a new one, or a method which also uses a composite label already produced to affix another second print image to the second print image portion thereof, as well as a method which produces a composite label such that a second print image portion thereof is different from the other portions from the beginning.

For instance, as shown in FIG. 4D, there is provided a composite label Ls which has a second label L0*c* affixed to the first tape T1 (first label L0*a*), described hereinabove, having a first tape width of 24 mm with a white background. The second label L0*c* is produced by printing black characters "● WHITE RING" on a second tape Ts having a second tape width of 18 mm with a yellow background. Now, by affixing the second label L0*b* in place of the second label L0*c* which has been peeled off, described above with reference to FIG. 4B, the composite label L0, described above with reference to FIG. 4C, can be produced. In this case, as described above (as shown in FIG. 4A), if the size information of the second print image (e.g. width and length) is printed in the contour image G12 in advance, even when the former second print image (i.e. the second label L0*c,* in this example) is peeled off, it is possible to easily grasp the size of a second print image (i.e. the second label L0*b*) to be newly produced (affixed). Further, when the above composite label Ls is provided, even if the second label L0*b* is affixed to the second label L0*c* without peeling off the second label L0*c,* the composite label L0 can be produced. In this case, as shown in FIGS. 4B to 4D, size information (size mark) Ms ("18–36" in the example illustrated in the figures) may be included in part (e.g. an end portion) of the second print image. Further, the size information may be represented such that "W18×L36" in addition to "TAPE WIDTH 18 mm, TAPE LENGTH 36 mm" in FIG. 4*a,* and the above "18–36". Alternatively, it may be represented by numbers or the like indicative of the types of tapes.

Although in the above embodiment, only methods are employed by way of example, in which priority is given to paragraphs when a whole print image includes a plurality of paragraphs and a plurality of lines, this is not limitative, but lines may be arranged independently of the plurality of paragraphs. For instance, the methods can be applied to produce a whole (composite) image having lines and paragraphs arbitrarily arranged, and a composite label formed by the whole (composite) image. Such a whole image is constructed e.g. by arranging a line extending in the direction of the length of the tape, such as examples illustrated in FIGS. 4A to 6D, or FIGS. 8A to 10D, at a location on the upper side of the tape in the direction of the width thereof, and thereafter arranging a plurality of paragraphs shown in FIGS. 7A to 7D, below the above line, or alternatively by newly providing the whole of an image having the above paragraphs and lines mixed with each other as a large paragraph to further arrange new (large) paragraphs at locations forward and rearward of the paragraph.

Although in the above embodiment, description has been given of examples in which a literal string is subjected to operations for editing and printing, this is not limitative, but nonstandard characters and figures or the like arbitrarily registered and formed as well as a mixture thereof may be edited for printing, similarly to each paragraph, each line, each literal string, each character, and so forth, so long as they can form a first print image as the base of a whole. Further, although in the above embodiment, description has been given of a tape printing apparatus of a thermal type, the present embodiment can be applied to tape printing apparatuses of an ink jet type or the like.

It is further understood by those skilled in the art that the foregoing is a preferred embodiment of the invention, and that various changes and modifications may be made without departing from the spirit and scope thereof.

What is claimed is:

1. An image forming method for a tape printing apparatus that prints at least a first print image adapted to a first tape on at least the first tape, the image forming method comprising the steps of:

setting a second print image area as an affixing area for having a second print image, such that the second print image can be affixed to the affixing area, the second print image being printed on a second tape having a width equal to or smaller than that of the first tape; and forming a first print image having the second print image area provided therein.

2. An image forming method according to claim 1, wherein the first print image includes a plurality of paragraphs, and wherein the step of setting the second print image area includes assigning at least one of the plurality of paragraphs to the second print image area.

3. An image forming method according to claim 1, wherein the first print image includes a plurality of lines, and wherein the step of setting the second print image area includes assigning at least one of the plurality of paragraphs to the second print image area.

4. An image forming method according to claim 1, wherein the first print image has a literal string formed of a plurality of characters, and wherein the step of setting the second print image area includes assigning at least part of the literal string to the second print image area.

5. An image forming method according to claim 1, wherein the first print image includes a plurality of characters, and wherein the step of setting the second print image area includes assigning at least one of the plurality of characters to the second print image area.

6. An image forming method according to claim 1, wherein the step of setting the second print image area includes setting the second print image area such that the second print image area is contained in the area of the first print image in a manner enclosed by a double enclosing box.

7. An image forming method according to claim 1, wherein the step of forming the first print image includes forming the first print image such that the first print image includes a mark image for specifically indicating the second print image area.

8. An image forming method according to claim 7, wherein the second print image area is set as a polygonal area, and wherein the step of forming the first print image includes forming the first print image such that the first print image includes corner marks as the mark image, the corner marks indicating respective positions of corners of the polygonal area.

9. An image forming method according to claim 7, wherein the step of forming the first print image includes forming the first print image such that the first print image includes a contour image as the mark image, the contour image indicating an outline of the second print image area by a dotted line or a solid line.

10. An image forming method according to claim 7, wherein the mark image is arranged such that the mark image is hidden under the second print image when the second print image is affixed.

11. An image forming method according to claim 1, wherein the step of forming the first print image includes forming the first print image such that a color different from colors in other areas of the first print image is arranged in either a whole area of the second print image or an area narrower than the whole area of the second print image by a predetermined extent, and wherein the second print image area is specifically shown by a boundary line of arrangement of the different colors.

12. An image forming method according to claim 1, further including the step of forming the second print image before the first print image is printed.

13. An image forming method according to claim 12, further including the step of displaying a synthetic image which is formed by synthesizing the second print image with the first print image in a manner superposed on the second print image area.

14. An image forming method according to claim 1, wherein the first tape and the second tape are different in kind from each other.

15. An image forming method according to claim 1, wherein the second tape is a transparent tape.

16. A tape printing apparatus according to claim 15, wherein the second print image area is set as a rectangular area containing the outline, and wherein said second print image area outline-determining means includes at least one of:

length input means for inputting a length of the second print image area, and width input means for inputting a width of the second print image area.

17. A tape printing apparatus according to claim 16, wherein said width input means includes second tape width input means for inputting the second tape width.

18. A label producing method comprising the steps of:

setting a second print image area as an affixing area for having a second print image affixed thereto, in an area of the first print image, such that the second print image can be affixed to the affixing area, the second print image being printed on a second tape having a width equal to or smaller than that of the first tape;

forming a first print image having the second print image area provided therein;

printing the first print image on the first tape to produce a first label having the first print image printed thereon;

mounting the second tape in a tape printing apparatus;

printing the second print image on the second tape; and producing a second label having the second print image printed thereon.

19. A tape printing apparatus comprising:

first tape-mounting means for mounting a first tape having a first tape width as a print medium on which a first print image is to be printed;

second print image area-setting means for setting a second print image area for having a second print image affixed thereto, in an area of the first print image, the second print image being printed on a second tape having a second tape width equal to or smaller than that of the first tape;

first print image-forming means for forming the first print image having the second print image area provided therein; and first tape-printing means for printing the first print image on the first tape.

20. A tape printing apparatus according to claim 19, wherein said first print image-forming means includes first print image edit means for editing the first print image, said second print image area-setting means including tape shift-instructing means for issuing a tape shift instruction to hierarchically shift a tape edit mode from a first tape edit mode for carrying out an edit operation for the first tape to a second tape edit mode for carrying out an edit operation for the second tape, and wherein said second print image area-setting means is enabled to set the second print image area when the tape shift instruction is issued.

21. A tape printing apparatus according to claim 20, wherein said first print image edit means includes paragraph break insertion-instructing means for issuing a paragraph break insertion instruction for providing a new paragraph in the first print image, and wherein said second print image area-setting means includes tape shift/paragraph break insertion-setting means for setting the new paragraph as the second print image area when the paragraph break insertion instruction and the tape shift instruction are issued simultaneously or in a predetermined sequence.

22. A tape printing apparatus according to claim 20, wherein said first print image edit means includes new line start-instructing means for issuing a new line start instruction for starting a new line in the first print image, and wherein said second print image area-setting means includes tape shift/new line start-setting means for setting the new line as the second print image area when the new line start instruction and the tape shift instruction are issued simultaneously or in a predetermined sequence.

23. A tape printing apparatus according to claim 20, wherein said first print image edit means includes literal string range-designating means for carrying out literal string range designation for designating a range of part of a literal string in the first print image, and wherein the second print image area-setting means further includes tape shift/literal string range-setting means for setting the range of the part of the literal string designated by the literal string range-designating means as the second print image area when the literal string range designation and the tape shift instruction are issued simultaneously or in a predetermined sequence.

24. A tape printing apparatus according to claim 20, wherein said first print image edit means includes character-designating means for carrying out character designation for designating at least one character in the first print image, and wherein said second print image area-setting means further includes tape shift/character-setting means for setting a range of the at least one character designated by said character-designating means as the second print image area when the character designation and the tape shift instruction are issued simultaneously or in a predetermined sequence.

25. A tape printing apparatus according to claim 23, further including second tape print character size-determining means for determining a size of characters in the second print image in said second tape edit mode, and wherein said first print image edit means includes character size-adjusting means for adjusting a size of characters in the first print image based on the determined size of characters in the second print image.

26. A tape printing apparatus according to claim 20, wherein said first print image edit means includes enclosing box-instructing means for issuing an enclosing box instruction for causing the first print image to be formed as an image with an enclosing box, and wherein said second print image area-setting means further includes second tape box-setting means for setting an internal area of the first print image, obtained by excluding, from an area of the first print image, a portion having a predetermined width and extending along a periphery of the area as the second print image area when the enclosing box instruction and the tape shift instruction are issued simultaneously or in a predetermined sequence.

27. A tape printing apparatus according to claim 20, wherein said second print image area-setting means further includes tape shift cancellation-instructing means for issuing a tape shift cancellation instruction for restoring the apparatus from the second tape edit mode to the first tape edit mode after setting the second print image area.

28. A tape printing apparatus according to claim 27, wherein the tape shift cancellation instruction is issued through the same operation as carried out for issuing the tape shift instruction.

29. A tape printing apparatus according to claim 19, wherein said first tape-mounting means is configured such that the second tape can be mounted therein, and includes second tape-mounting detection means for detecting that the first tape has been replaced by the second tape.

30. A tape printing apparatus according to claim 19, further including display means for displaying the first print image and the second print image area set in the area of the first print image, and at the same time specifically indicating the second print image area.

31. A tape printing apparatus according to claim 30, wherein said second print image area-setting means includes area-designating means which is capable of effecting area designation for setting the second print image area in the area of the first print image displayed by said display means.

32. A tape printing apparatus according to claim 19, wherein said second print image area-setting means includes second tape type-designating means for designating a type of the second tape from a plurality of types of tapes.

33. A tape printing apparatus according to claim 32, wherein said second print image area-setting means includes second print image area outline-determining means for determining an outline of the second print image area.

34. A tape printing apparatus according to claim 33, wherein said second print image area outline-determining means determines a line outlining a periphery of a non-transparent portion in the second print image, as an outline of the second print image area when a transparent tape is designated as the second tape.

35. A tape printing apparatus according to claim 33, wherein said second print image area outline-determining means determines a line indicating a contour of an area for having the second tape printed with the second print image affixed thereto, as an outline of the second print image area when a non-transparent tape is designated as the second tape.

36. A tape printing apparatus according to claim 19, wherein said first print image-forming means includes second print image area-indicating means for providing the first print image with an area-indicating function for specifically indicating the second print image area provided as an affixing area, after printing.

37. A tape printing apparatus according to claim 36, wherein the second print image area is set as a polygonal area, and wherein said second print image area-indicating means includes corner mark-arranging means for printably arranging corner marks indicating respective positions of corners of the second print image area or corner marks indicating respective positions deviated from the positions of the corners in respective predetermined directions by a predetermined distance, in the area of the first print image.

38. A tape printing apparatus according to claim 36, wherein said second print image area-indicating means includes outline-arranging means for printably arranging a dotted line or a solid line indicating at least one of an outline of the second print image area and an outline deviated from the outline inward by a predetermined width, in the area of the first print image.

39. A tape printing apparatus according to claim 36, wherein said second print image area-indicating means includes second print image area color-arranging means for specifically showing a boundary dividing the second print image area and the first print image by arranging a color different from a color arranged in another area of the first print image, in one of the second print image area and an area narrower than the second print image area by a predetermined extent.

* * * * *